US005989096A

United States Patent [19]

Barton et al.

[11] Patent Number: 5,989,096

[45] Date of Patent: Nov. 23, 1999

[54] TOY FORK LIFT VEHICLE WITH IMPROVED STEERING

[75] Inventors: William M. Barton, Encinitas; Lonnie C. Pogue; Jon M. Drechny, both of San Diego, all of Calif.

[73] Assignee: Rokenbok Toy Company, Encinitas, Calif.

[21] Appl. No.: 08/797,190

[22] Filed: Feb. 11, 1997

[51] Int. Cl.[6] ..... A63H 17/05; A63H 30/00

[52] U.S. Cl. ..... 446/425; 446/427; 446/434; 446/456

[58] Field of Search ..... 446/424, 425, 446/427, 434, 435, 441, 454, 455, 456

[56] References Cited

U.S. PATENT DOCUMENTS

| | | | |
|---|---|---|---|
| 2,354,178 | 7/1944 | Ulinsky . | |
| 2,586,239 | 2/1952 | MacKenzie | 446/427 |
| 3,303,821 | 2/1967 | Harris | 119/29 |
| 3,400,488 | 9/1968 | Phillpott et al. | 469/244 |
| 3,482,046 | 12/1969 | Hughson et al. | 179/154 |
| 3,639,755 | 2/1972 | Wrege | 246/187 B |
| 3,722,135 | 3/1973 | Jacobson | 446/425 |
| 3,744,181 | 7/1973 | Gagnon | 446/425 |
| 3,747,265 | 7/1973 | Gagnon | 446/454 |
| 3,772,825 | 11/1973 | Gagnon | 446/454 |
| 3,782,031 | 1/1974 | Byron | 46/244 R |
| 3,874,539 | 4/1975 | Staley . | |
| 3,926,434 | 12/1975 | Cannon, Jr. | 273/86 B |
| 4,013,185 | 3/1977 | Bratton . | |
| 4,080,602 | 3/1978 | Hattori et al. | 343/225 |
| 4,087,799 | 5/1978 | Brouwer | 340/237.5 |
| 4,135,181 | 1/1979 | Bogacki et al. | 340/310 A |
| 4,141,553 | 2/1979 | Beny et al. | 273/86 B |
| 4,171,468 | 10/1979 | Reiner | 179/15 AW |
| 4,197,672 | 4/1980 | Mabuchi et al. | 46/254 |
| 4,213,270 | 7/1980 | Oda | 46/254 |
| 4,226,292 | 10/1980 | Monte et al. | 180/6.5 |
| 4,334,221 | 6/1982 | Rosenhagen et al. | 340/825.72 |
| 4,563,626 | 1/1986 | Ohtake | 320/2 |
| 4,817,948 | 4/1989 | Simonelli | 273/86 B |
| 4,917,649 | 4/1990 | Tammera | 446/441 |
| 4,938,483 | 7/1990 | Yavetz | 446/456 |
| 5,073,750 | 12/1991 | Coron | 318/58.7 |
| 5,098,110 | 3/1992 | Yang | 273/438 |
| 5,135,427 | 8/1992 | Suto et al. | 446/433 |
| 5,148,159 | 9/1992 | Clark et al. | 340/825.22 |
| 5,364,108 | 11/1994 | Esnouf | 273/430 |
| 5,429,543 | 7/1995 | Tilbor et al. | 446/456 |
| 5,435,553 | 7/1995 | Arima et al. | 273/865 |
| 5,435,768 | 7/1995 | Dunleavy | 446/427 |
| 5,452,901 | 9/1995 | Nakada et al. | 273/310 |
| 5,471,668 | 11/1995 | Soenen et al. | 455/352 |
| 5,474,486 | 12/1995 | Chilton et al. | 456/456 |

FOREIGN PATENT DOCUMENTS

| | | | |
|---|---|---|---|
| 939976 | 3/1956 | Germany | 446/425 |
| 1196554 | 7/1965 | Germany | 446/424 |
| 2005158 | 8/1971 | Germany | 446/424 |

*Primary Examiner*—Robert A. Hafer
*Assistant Examiner*—Jeffrey D. Carlson
*Attorney, Agent, or Firm*—Ellsworth R. Roston; Fulwider, Patton, et al.

[57] ABSTRACT

A remotely-controllable motorized toy vehicle having a highly-maneuverable skid steering system driven by single or dual motors, having a separately motorized lift device pivotally secured to the chassis of the vehicle operative to lift and transport transportable elements, and also having an automatic tow hitch mechanism. The lift and hitching mechanism is coupled to a motorized lift gear train which provides for the sequential actuation of the lift for lifting and transport of the transportable elements and acutation of the hitch mechanism for hitching and unhitching towed vehicles. The vehicle is constructed with a particular wheel track to wheel base ratio providing improved skid steering as well as enhanced manueverability and stability. The mechanisms and gear trains have proper ratios and dimensions providing for the proper sequence of hitch actuation during upward and downward movement of the lift device whereby the hitch is operative only upon extended upward operation of the lift. The remote central control device or station being capable of controlling a plurality of vehicles with control inputs from a plurality of operators.

59 Claims, 10 Drawing Sheets

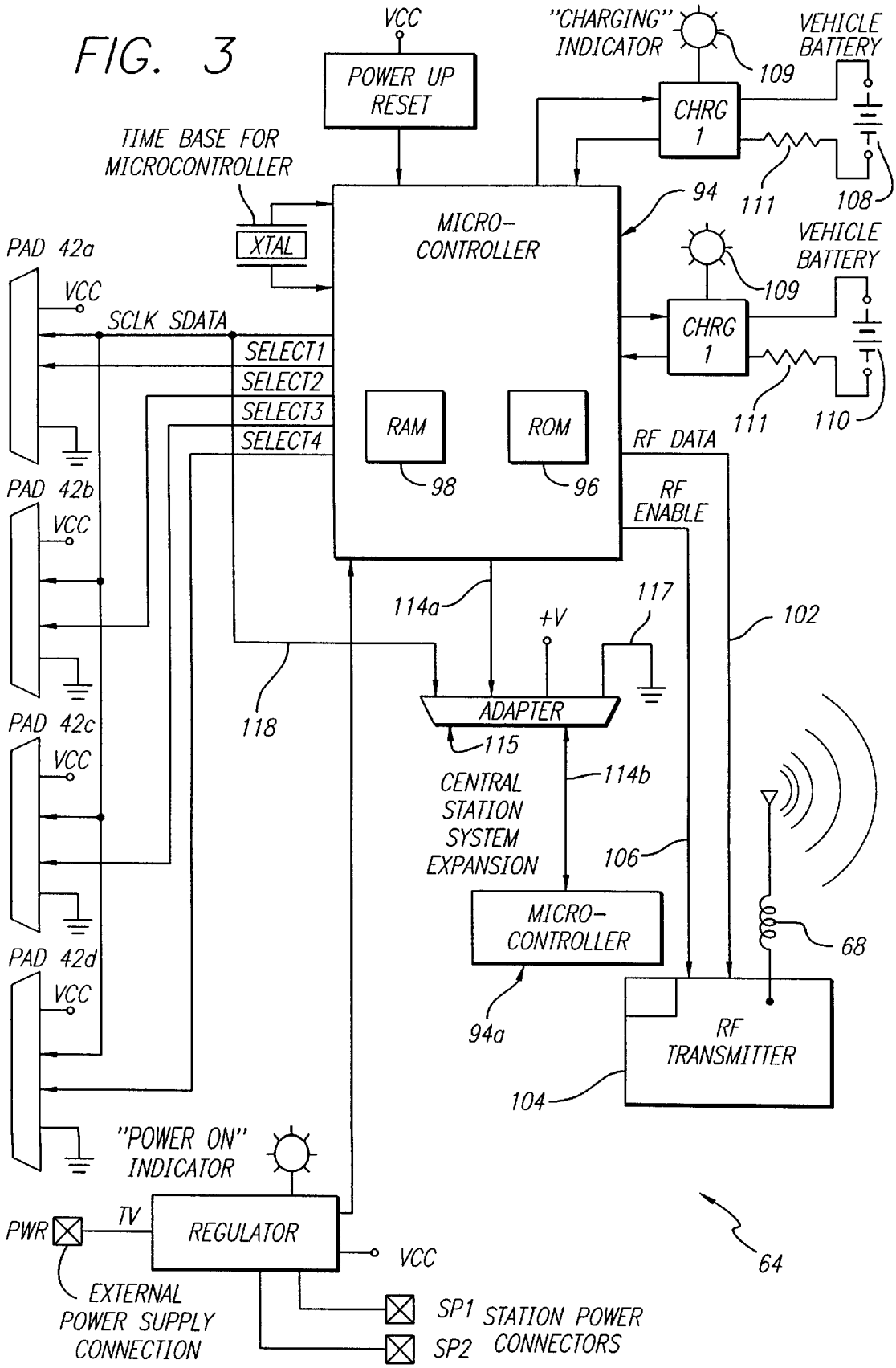
FIG. 3
VCC
POWER UP RESET
"CHARGING" INDICATOR
VEHICLE BATTERY
109
CHRG 1
TIME BASE FOR MICROCONTROLLER
XTAL
MICRO-CONTROLLER
94
111
108
VEHICLE BATTERY
109
CHRG 1
111
110
PAD 42a
VCC
SCLK SDATA
SELECT1
SELECT2
SELECT3
SELECT4
RAM
ROM
98
96
RF DATA
RF ENABLE
PAD 42b
VCC
114a
+V
117
102
118
ADAPTER
115
PAD 42c
VCC
CENTRAL STATION SYSTEM EXPANSION
114b
106
MICRO-CONTROLLER
68
PAD 42d
VCC
94a
RF TRANSMITTER
104
"POWER ON" INDICATOR
PWR
TV
REGULATOR
VCC
64
EXTERNAL POWER SUPPLY CONNECTION
SP1
SP2
STATION POWER CONNECTORS VCC
POWER UP RESET
VCC
122
12
134
TIME BASE FOR MICROCONTROLLER
XTAL
MICRO-CONTROLLER
RAM
ROM
126
124
VEHICLE ADDRESS SELECT
128
130
132
MOTOR 1
28
TRANSISTOR DRIVER
4
120
MOTOR 2
30
TRANSISTOR DRIVER
4
120
MOTOR 3
32
TRANSISTOR DRIVER
4
120
MOTOR 4
33
TRANSISTOR DRIVER
4
120
POWER ON
69
RF POWER MANAGEMENT
RF RECEIVER
121
BATTERY
VCC
4.5V
GND

TOY FORK LIFT VEHICLE WITH IMPROVED STEERING

BACKGROUND OF THE INVENTION

1. Field of the Invention

This invention relates to a system for pleasurable use by people of all ages with youthful minds in operating remotely controlled vehicles simultaneously in a somewhat confined area. In the system of this invention, the vehicles can be remotely controlled to perform competitive or cooperative tasks. The system includes control pads for operation by the users, vehicles remotely controlled in accordance with the operation of the control pads and a central station for coordinating the operation of the control pads and the vehicles. In addition to the inventive aspects of the system, each of the control pads, the central station and the vehicles includes features of an inventive nature. The system of this invention also includes stationary plants (e.g. power plants and elevators) which are controlled by the operation of the control pads. The invention additionally relates to methods including methods for controlling the operation of the vehicles on a remotely controlled basis.

More specifically, this invention relates to remotely controlled vehicles having inventive features such as toy self-loading dump trucks, trailers, forklifts and bulldozers that can be operated to mimic the operation of similar full-size vehicles by employing highly-maneuverable skid steering, having automatic tow hitch actuation mechanisms and having motorized accessories for scooping up transportable elements, transferring the transportable elements to a hopper, automatically activating the hopper to dump the transportable elements, for gripping, lifting and translating transportable elements, and for pushing transportable elements along a surface.

2. Description of the Related Art

Various types of toy systems exist, and have existed for some time, in which vehicles are moved on a remotely controlled basis. Examples of a vehicle in such a system are an automobile, airplane, truck, water vehicle or construction vehicle. In most such systems, however, the functions and activities that the vehicle is capable of are limited to merely maneuvering a vehicle about on the ground, in the air or in the water. Other types of toy systems involve the use of blocks for building structures. These blocks often include structure for providing an interlocking relationship between abutting blocks. In this way, elaborate structures can be created by users with creative minds. However, such structures are generally built by hand manipulation of the blocks or hand manipulation of a mechanism of toy vehicle for handling the blocks.

Experience has proven that there is a desirability, and even a need, for play systems in which vehicles are remotely operated to perform functions other than merely being steered or maneuvered through a path of travel. For example, there exists a desire for a play system in which the remotely controlled vehicles have the capability of transporting elements such as building blocks maneuverable into position to build a toy or other structure. It is desirable that such systems employ a plurality of vehicles remotely controlled by switches in hand-held control pads so that users can compete against one another in performing various tasks such as moving building blocks or marbles.

Co-pending application Ser. No. 08/580,753 filed by John J. Crane on Dec. 29, 1995, for a "Remote Control System for Operating Toys" and assigned of record to the assignee of record of this application discloses and claims a play system for use by people of all ages with youthful minds. It provides for a simultaneous control by each player of an individual one of a plurality of remotely controlled vehicles. This control is provided by the operation by each such player of switches in a hand-held unit or pad, the operation of each switch in such hand-held unit or pad providing a control of a different function in the individual one of the remotely controlled vehicles. Each of the remotely controlled vehicles in the system disclosed an claimed in application Ser. No. 08/580,753 can be operated in a competitive relationship with others of the remotely controlled vehicles or in a co-operative relationship with others of the remotely controlled vehicles. The vehicles can be constructed to pick up and transport elements such as blocks or marbles and to deposit such elements at displaced positions.

When manually closed in one embodiment of the system disclosed and claimed in application Ser. No. 08/580,753, switches in pads control the selection of toy vehicles and the operation of motors for moving the vehicles forwardly, rearwardly, to the left and to the right and moving upwardly and downwardly (and rightwardly and leftwardly) a receptacle for holding transportable elements (e.g. marbles) or blocks.

When sequentially and cyclically interrogated by a central station, each pad in the system disclosed and claimed in application Ser. No. 08/580,753 sends through wires to the central station signals indicating the switch closures in such pad. Such station produces first binary signals addressing the vehicle selected by such pad and second binary signals identifying the motor control operations in such vehicle. Thereafter the switches identifying in such pad the control operations in such selected vehicle can be closed without closing the switches identifying such vehicle.

The first and second signals for each vehicle in the system disclosed and claimed in application Ser. No. 08/580,753 are transmitted by wireless by the central station to all of the vehicles at a common carrier frequency modulated by the first and second binary signals. The vehicle identified by the transmitted address demodulates the modulating signal and operates its motors in accordance with such demodulation. When the station fails to receive signals from a pad for a particular period of time, the vehicle selected by such pad becomes available for selection by another pad and such pad can select that vehicle or another vehicle.

A cable may couple two (2) central stations (one as a master and the other as a slave) in the system disclosed and claimed in application Ser. No. 08/580,753 so as to increase the number of pads controlling the vehicles. Stationary accessories (e.g. elevator) connected by wires to the central station become operative when selected by the pads.

Co-pending application Ser. No. 08/763,678 filed by William M. Barton, Jr., Peter C. DeAngelis and Paul Eichen on Dec. 11, 1996 for a "System For And Method Of Selectively Providing The Operation Of Toy Vehicles" and assigned of record to the assignee of record of this application discloses and claims a system wherein a key in a vehicle socket closes contacts to reset a vehicle microcontroller to a neutral state. Ribs disposed in a particular pattern in the key operate switches in a particular pattern in the vehicle to provide an address for the vehicle with the vehicle inactive but powered. When the vehicle receives such individual address from an individual one of the pads in a plurality within a first particular time period thereafter, the vehicle is operated by commands from such pad. Such individual pad operates such vehicle as long as such vehicle receives commands from such individual pad within the first particular period after the previous command from such individual pad. During this period, the vehicle has a first illumination to indicate that it is being operated.

When the individual pad of the system disclosed and claimed in application Ser. No. 08/763,678 fails to provide commands to such vehicle within such first particular time period, the vehicle becomes inactive but powered and provides a second illumination. While inactive but powered, the vehicle can be addressed and subsequently commanded by any pad including the individual pad, which thereafter commands the vehicle. The vehicle becomes de-activated and not illuminated if (a) the vehicle is not selected by any of the pads during a second particular time period after becoming inactivated but powered or, alternatively, (b) all of the vehicles become inactivated but powered and none is selected during the second particular period. The vehicle becomes de-activated and not illuminated. The key can thereafter be actuated to operate the vehicle to the inactive but powered state.

Co-pending application Ser. No. 08/696,263, filed by Peter C. DeAngelis on Aug. 13, 1996 for a "System And Method Of Controlling The Operation Of Toys" and assigned of record to the assignee of record of this application discloses and claims a system wherein individual ones of pads remotely control the operation of selective ones of vehicles. In each pad, (a) at least a first control provides for the selection of one of the vehicles, (b) second controls provide for the movement of the selected vehicle and (c) third controls provide for the operation of working members (e.g. pivotable bins) in the selected vehicle. Each pad provides a carrier signal, preferably common with the carrier signals from the other pads. Each pad modulates the carrier signal in accordance with the operation of the pad controls. The first control in each pad provides an address distinctive to the selected one of the vehicles and modulates the carrier signal in accordance with such address.

Each pad of the system disclosed and claimed in application Ser. No. 08/696,263 sends the modulated carrier signals to the vehicles in a pseudo random pattern, different for each pad, with respect to time. Each vehicle demodulates the carrier signals to recover the address distinctive to such vehicle. Each vehicle then provides a movement of such vehicle and an operation of the working members in such vehicle in accordance with the modulations provided in the carrier signal by the operation of the second and third controls in the pads selecting such vehicle. Each vehicle is controlled by an individual one of the pads for the time period that such pad sends control signals to such vehicle within a particular period of time from the last transmission of such control signals to such vehicle. Thereafter such vehicle can be selected by such pad or by another pad.

What has been needed, and heretofore unavailable, is a toy system including vehicles remotely operated to accomplish tasks such as lifting, scooping, dumping, leveling, pushing and hauling suitably sized materials and towing of trailers carrying such material, or other vehicles, in combination to create a miniature community or industrial environment, thus providing a person having a youthful mind with the opportunity to employ a remotely-controlled system of vehicles and mechanisms to accomplish these tasks and others within a reduced-scale, industrial environment in cooperation or competition with other individuals in a pleasurable manner.

SUMMARY OF THE INVENTION

The toy vehicle disclosed herein comprises a wheeled, highly-maneuverable, motor driven, skid steering, fork lift vehicle with a gripping lifter having the capability to releasably tow other vehicles and which is compatible with a sophisticated remote-control system. Either single or dual motors are employed to drive the wheels and skid steering while only a single additional motor is employed to drive the lifter and hitching mechanisms. Another motor is shown in the disclosed embodiment for driving the gripping mechanism.

The toy fork lift vehicle is for use as part of a toy system for use by people of all ages with youthful minds. The system provides for a simultaneous control by each player of an individual one of a plurality of remotely controlled vehicles, including the forklift vehicle. This control is provided by the operation by each such player of switches in a hand-held unit or control pad, the operation of each switch in such hand-held unit providing a control of a different function in the individual one of the remotely controlled vehicles.

Each of the remotely controlled vehicles in the system of this invention can be operated in a competitive relationship with others of the remotely controlled vehicles or in a cooperative relationship with others of the remotely controlled vehicles. The vehicles can be constructed to pick up and transport elements such as blocks or marbles or other transportable elements and to deposit such elements at displaced positions. Moreover, the vehicles are constructed having a particular ration of wheel track to wheel base to improve the maneuverability and stability of the vehicle while utilizing skid steering to steer the vehicle.

When manually closed in one embodiment of the invention, switches in control pads control the selection of toy vehicles and the operation of motors for moving the vehicles forwardly, rearwardly to the left and to the right and moving upwardly and downwardly (and rightwardly and leftwardly) a receptacle for holding, lifting and transporting transportable elements (e.g. marbles).

When sequentially and cyclically interrogated by a central station, each control pad sends through wires to the station signals indicating the switch closures in such control pad. Such station produces first binary signals addressing the vehicle selected by such control pad and second binary signals identifying the motor control operations in such vehicle. Thereafter the switches identifying in such control pad the motor control operations in such selected vehicle can be closed without closing the switches identifying such vehicle.

The first and second signals for each vehicle are transmitted by wireless to all of the vehicles at a common carrier frequency modulated by the first and second binary signals. The vehicle identified by the transmitted address demodulates the modulating signals and operates its motors in accordance with such demodulation. When the station fails to receive signals from a control pad for a particular period of time, the vehicle selected by such control pad becomes available for selection by another control pad and such control pad can select that vehicle or another vehicle.

A cable may couple two (2) central stations (one as a master and the other as a slave) to increase the number of control pads controlling by the vehicles. Stationary accessories (e.g. elevator) connected by wires to the central station become operative when selected by the control pads.

BRIEF DESCRIPTION OF THE DRAWINGS

In the drawings, where like reference numerals indicate like or similar components, elements and features across the several figures:

FIG. 3 is a schematic diagram, primarily in block form, of the different features included in a central station included in the system shown in FIG. 1;

DETAILED DESCRIPTION OF THE PREFERRED EMBODIMENTS

The drawings will now be described in more detail, wherein like referenced numerals refer to like or corresponding elements among the several drawings. Moreover, reference may be made to United States patent applications Ser. No. 08/580,753, Ser. No. 08/763,678 and Ser. No. 08/696,263, which are hereby incorporated in their entirety.

Figure 1:
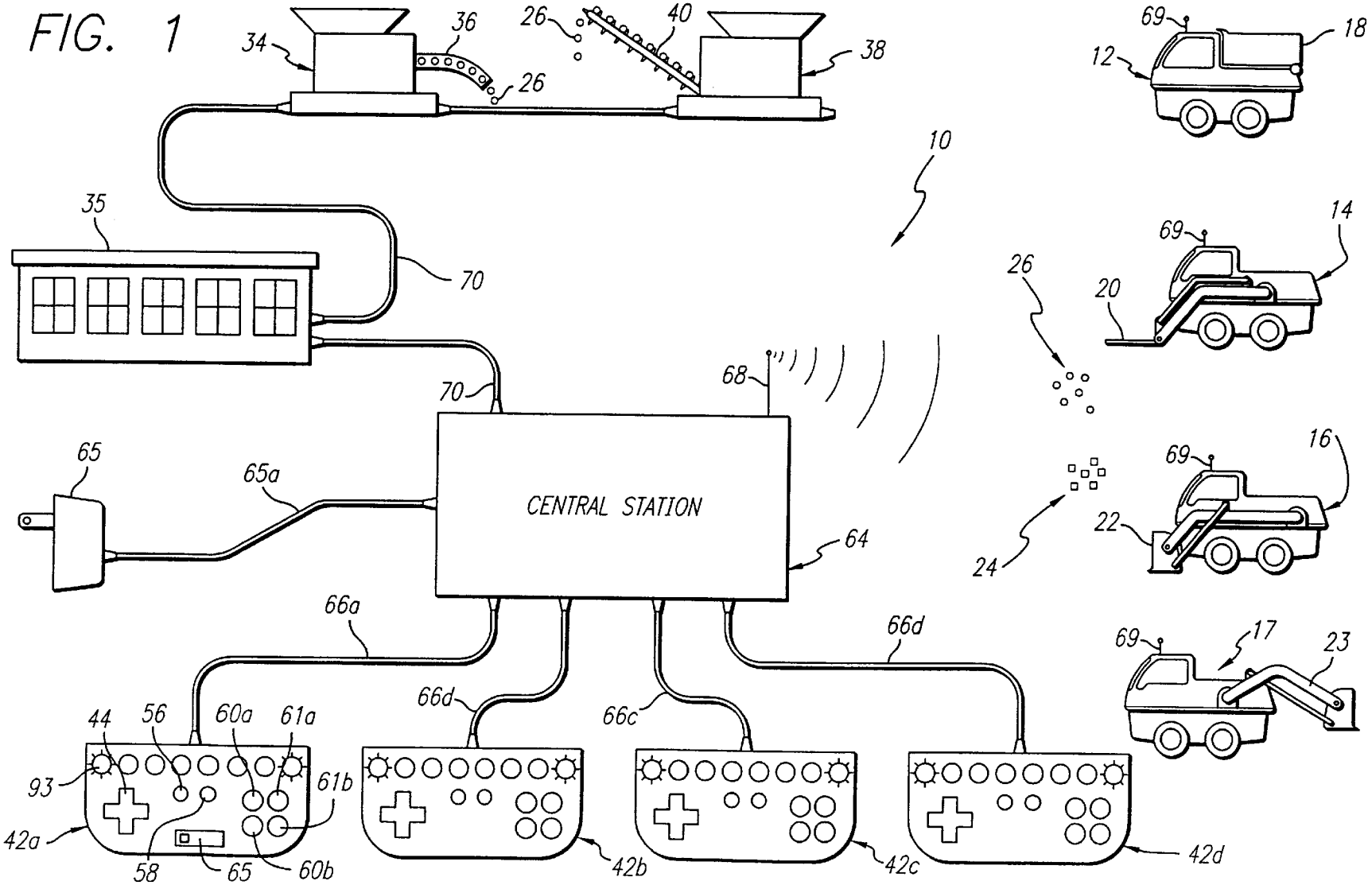
FIG. 1 is a schematic diagram of a system constituting one embodiment of the remote-control system invention.

In one embodiment of the invention, a system generally indicated at 10 in FIG. 1 is provided for controlling the selection and operation of a plurality of toy vehicles. Illustrative examples of toy vehicles constitute a dump truck, generally indicated at 12, a fork lift, generally indicated at 14, a skip loader, generally indicated at 16 and another form of skip loader, generally indicated at 17. The toy vehicles such as the dump truck vehicle 12, the fork lift 14 and the skip loaders 16 and 17 are simplified small scale replicas of corresponding full-size commercial units. For example, the dump truck vehicle 12 may include a working or transport member such as a pivotable tip up bin or container 18; the fork lift 14 may include a working or transport member such as a pivotable platform 20; the skip loader 16 may include a working or transport member such as a pivotable bucket 22 disposed at the front end of the skip loader; and the skip loader 17 may include a working or transport member such as a pivotable bin or container 23 disposed at the rear end of the skip loader. The working or transport members such as the pivotable bin or container 18, the pivotable platform 20 and the pivotable bins or containers 22 and 23 are constructed to carry storable and/or transportable eletnents such as blocks 24 or marbles 26 shown schematically in FIG. 1.

Each of the toy vehicles 12, 14, 16 and 17 may also have a trailer hitch 19 mounted on the front or rear of the vehicle for hooking a hitch member of another vehicle, such as a trailer (not shown) to the hitch 19 of the vehicles 12, 14, 16 and 17. The trailer hitch 19 may be remotely controlled in similar fashion to the working or transport member of the toy vehicle. Alternatively, the trailer hitch may be mechanically interconnected with the working or transport member such that remote control of the working or transport member also controls the trailer hitch 19.

Each of the dump truck 12, the fork lift 14 and the skip loaders 16 and 17 may include a plurality of motors. For example, the dump truck 12 includes a pair of reversible motors 28 and 30 (FIG. 4) to move the dump truck vehicle forwardly or rearwardly and to pivot the vehicle to the right or to the left. The motor 28 drives the movement of the front and rear wheels on the left side of the dump truck 12, and the motor 30 drives the front and rear wheels on the right side of the dump truck 12.

When the motors 28 and 30 are simultaneously operated in one direction, the dump truck 12 moves forwardly. The dump truck 12 moves rearwardly when the motors 28 and 30 are moved in the opposite direction. The dump truck 12 turns toward the left when the motor 30 is operated without simultaneous operation of the motor 28. The dump truck 12 turns toward the right when the motor 28 is operated without a simultaneous operation of the motor 30.

The dump truck 12 spins to the right when the motor 30 operates to move the vehicle forwardly at the same time that the motor 28 operates to move the vehicle rearwardly. The dump truck 12 spins to the left when the motors 28, 30 are operated in directions opposite to the operations of the motors in spinning the vehicle to the right.

Another reversible motor 32 in the dump truck 12 operates in one direction to pivot the bin 18 about its rearward hinge 13 upwardly and in the other direction to pivot the bin downwardly. In another embodiment, continued rotation of the motor 32 to pivot the bin 18 in an upwardly direction may cause the trailer hitch 19 to open. When the motor 32 is operated in the other direction, the trailer hitch 19 closes and the bin 18 pivots downwardly. An additional motor 33 may operated in one direction to turn the bin 18 to the left and in the other direction to turn the bin 18 to the right.

The construction of the motors 28, 30, 32 and 33 and the disposition of the motors and controls in the dump truck 12 to operate the dump truck are considered to be well known in the art. The fork lift 14 and the skip loaders 16 and 17 may include motors to those described above for the dump truck 12.

The system 10 may also include remotely-controlled, motorized stationary plants or accessories. For example, it may include a remotely-controlled motorized pumping station, generally indicated at 34 (FIG. 1), and driven by a pumping motor responsive to a control (not shown), for pumping elements such as the marbles 26 from a hopper 34*a* through a conduit 36. The system may also include a remotely-controlled motorized conveyor, generally indicated at 38, and driven by a conveyor motor responsive to a control (not shown), for moving the elements such as the marbles 26 from a hopper 38*a* upwardly on a ramp 40. When the marbles 26 reach the top of the ramp 40, the elements such as the marbles 26 may fall into the bin 18 in the dump truck vehicle 12 or into the bin 22 in the skip loader 16 or 17. For the purposes of this application, the construction of the pumping station 34 and the conveyor 38 may be considered to be within the purview of a person of ordinary skill in the art. Accessories or stationary plants 34 and 38 may be connected to the central station 64 either directly or through a junction box such as miniature building 35 as shown in FIG. 1.

The system 10 may also include a plurality of hand held control pads, generally indicated at 42*a*, 42*b*, 42*c* and 42*d*

(FIG. 1). Each of such control pads may have a substantially identical construction. Each of the control pads may include a plurality of actuatable buttons. For example, each of the control pads may include 4-way cruciform buttons 44 configured with four wings disposed over respective control buttons 44 arranged to drive individual ones of a plurality of switches 46, 48, 50, and 52 (FIG. 2).

One wing of the button 44 may be depressed to engage the button associated with the switch 46 to close the circuit in one direction through the motor 28 (FIG. 4) moving the selected one of the vehicle 12 forwardly. Similarly, the opposite wing of button 44 may be depressed, to close the switch 48 to close the circuit in the opposite direction through motor 28 (FIG. 4) moving the vehicle 12 rearwardly. The selective depression of the left and right segments of the button 44 closes the respective switches 52 and 50, in turn, respectively closing the circuit in one direction then the opposite direction through the respective motors 28 and 30 respectively turning the selected vehicle 12 toward the left and the right about its vertical axis.

It will be appreciated that the buttons 44 may be tilted in one diagonal direction or the other by simultaneously pressing two neighboring wings of buttons 44 to simultaneously close respective neighboring pairs of switches 46 (forward) & 50 (right) to obtain a simultaneous movement of the vehicle 12 forwardly and to the right. However, a simultaneous actuation of the top and bottom wings of the button 44 will not have any effect since such actuations represent contradictory commands. This is also true of a simultaneous actuation of the left and right wings of the button 44.

Figure 2:
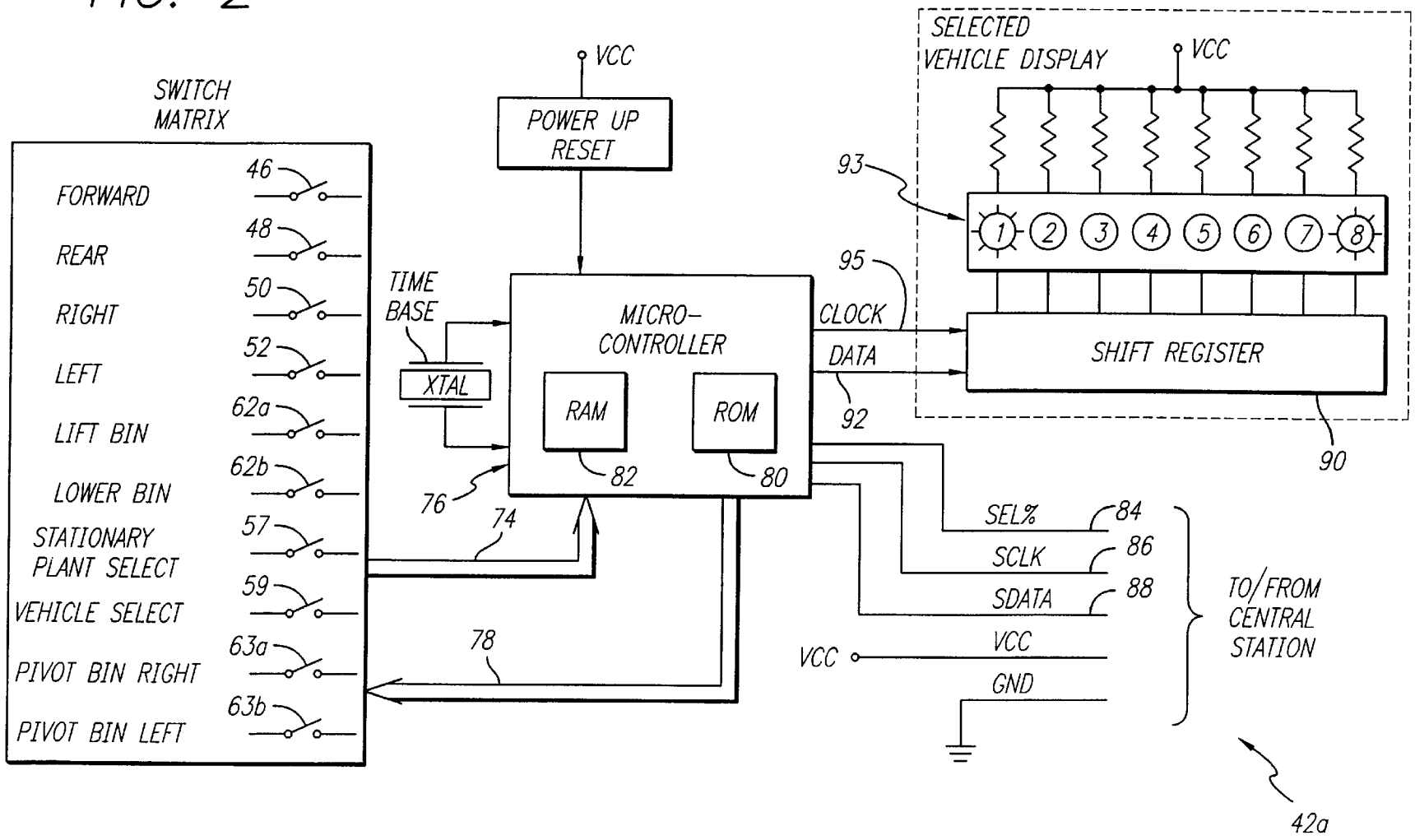
FIG. 2 is a schematic diagram, primarily in block form, of a control pad control system incorporated in the system shown in FIG. 1.

Each of the control pads 42*a*, 44*b*, 42*c* and 42*d* includes a button 56 (FIG. 1) connected to switch 57 (FIG. 2). Successive depressions of the button 56 within a particular period of time cause different ones of the stationary accessories or plants such as pumping station 34 and conveyer 38. For example, a first depression of the button 56 in one of the control pads 42*a*, 42*b*, 42*c* and 42*d* may cause the pumping station 34 to be energized and a second depression of the button 56 within the particular period of time in such control pad may cause the conveyor 38 to be energized. When other stationary accessories are included in the system 10, each may be individually energized by depressing the button 56 a selective number of times within the particular period of time. When the button 56 is depressed twice within the particular period of time, the energizing of the pumping station 34 is released and the conveyor 38 is energized. This energizing of a selective one of the stationary accessories occurs at the end of the particular period of time.

A vehicle selection button 58 is provided in each of the control pads 42*a*, 42*b*, 42*c* and 42*d* to select one of the vehicles 12, 14, 16 and 17. The individual one of the vehicles 12, 14, 16 and 17 selected at any instant by each of the control pads 42*a*, 42*b*, 42*c* and 42*d* is dependent upon the number of times that the button is depressed in that control pad within a particular period of time. For example, one (1) depression of the button 58 may cause the dump truck vehicle 12 to be selected and two (2) sequential selections of the button 58 within the particular period of time may cause the fork lift 14 to be selected.

Every time that the button 58 is actuated or depressed within the particular period of time, a switch 59 (in FIG. 2) is closed. The particular period of time for depressing the button 58 may have the same duration as, or a different time than, the particular period of time for depressing the button 56. An adder is included in the control pad 42 to count the number of depressions of the button 58 within the particular period of time. The count is converted into a plurality of binary signals indicating the count. The count is provided at the end of the particular period of time. Each individual count provides for a selection of a different one of the vehicles 12, 14, 16 and 17. The count representative of the selection of one of the vehicles 12, 14, 16 and 17 is maintained in a memory, which may be located either in the control pads 42*a*, 42*b*, 42*c* and 42*d*, or in the central station 64.

The control pads 42*a*, 42*b*, 42*c* and 42*d* include buttons 60*a* and 60*b*. When depressed, the buttons 60*a* and 60*b* respectively close switches 62*a* and 62*b* in FIG. 2. The closure of the switch 62*a* is instrumental in producing an operation of the motor 32 to lift the bin 18 in the dump truck 12 when the dump truck has been selected by the proper number of depressions of the button 58. In like manner, when the dump truck 12 has been selected by the proper number of depressions of the switch 58, closure of the switch 62*b* causes the bin 18 in the dump truck 12 to move downwardly as a result of the operation of the motor 32 in the reverse direction.

It will be appreciated that other controls may be included in each of the control pads 42*a*, 42*b*, 42*c* and 42*d*. For example, buttons 61*a* and 61*b* may be included in each of the control pads 42*a*, 42*b*, 42*c* and 42*d* (FIG. 1) which operate upon depression to close respective second accessory switches 63*a* and 63*b* (FIG. 2) to pivot the bin 18 to the right or left when the vehicle 12 has been selected. Such pivotal movements of bin 18 facilitate loading, transportation and unloading of transportable elements such as marbles 26 or blocks 24. It will be appreciated that different combinations of buttons may be actuated simultaneously to produce different combinations of motions. For example, a bin in a selected one of the vehicles may be moved at the same time that the selected one of the vehicles is moved.

A central station, generally indicated at 64 in FIG. 1, processes the signals from the individual ones of the control pads 42*a*, 42*b*, 42*c* and 42*d* and sends the processed signals to the vehicles 12, 14, 16 and 17 when the button 58 on an individual one of the control pads has been depressed to indicate that the information form the individual ones of the pads is to be sent to the vehicles. The transmission may be on a wireless basis from an antenna 68 (FIG. 1) in the central station to antennas 69 on the vehicles.

The transmission may be in packets of signals. This transmission causes the selected ones of the vehicles 12, 14, 16, 17 and 350 to perform individual ones of the functions directed by the depression of the different buttons on the individual ones of the control pads. When the commands from the individual ones of the control pads 42*a*, 42*b*, 42*c* and 42*d* are to pass to the stationary accessories 34 and 38 as a result of the depression of the buttons 56 on the individual ones of the pads, the central station process the commands and sends signals through cables 70 to the selected ones of the stationary accessories.

FIG. 2 shows the construction of the control pad 42*a* in additional detail. It will be appreciated that each of the control pads 42*b*, 42*c* and 42*d* may be constructed in a substantially identical manner to that shown in FIG. 2. As shown in FIG. 2, the control pad 42*a* includes the switches 46, 48, 50 and 52 and the switches 57, 59, 62*a*, 62*b*, 63*a* and 63*b*. Buses 74 are shown as directing signals from the switches 46, 48, 50, 52, 57, 59, 62*a*, 62*b*, 63*a* and 63*b* to a microcontroller, generally indicated at 76 in FIG. 2. Buses 78 are shown for directing signals from the microcontroller 76 to the switches.

The microcontroller 76 is shown as including a read only memory (ROM) 80 and a random access memory (RAM) 82. Such a microcontroller may be considered to be standard in the computing industry. However, the programming in the microcontroller and the information stored in the read only memory 80 and the random access memory 82 are individual to this invention.

The read only memory 80 stores permanent information and the random access memory stores volatile (or impermanent) information. For example, the read only memory 80 may store the sequence in which the different switches in the control pad 42*a* provide indications of whether or not they have been closed. The random access memory 82 may receive this sequence from the read only memory 80 and may store indications of whether or not the switches in the particular sequence have been closed for each individual one of the control pads 42*a*, 42*b*, 42*c* and 42*d*.

The control pad 42*a* in FIG. 2 receives the interrogating signals from the central station 64 through a line 84. These interrogating signals are not synchronized by clock signals on a line 86. Each of the interrogating signals intended for the control pad 42*a* may be identified by an address individual to such control pad. When the control pad 42*a* receives such interrogating signals, it sends to the central station 64 through lines 88 a sequence of signals indicating the status of the successive ones of the switches 46, 48, 50 and 52 and the switches 57, 59, 62*a*, 62*b*, 63*a* and 63*b*. These signals are synchronized by the clock signals on the line 86. It will be appreciated that the status of each of the switches 57 and 59 probably is the first to be provided in the sequence since these signals indicate the selection of the stationary accessories 34 and 38 and the selection of the vehicles 12, 14, 16 and 17.

As previously indicated, the control pad 42*a* selects one of the vehicles 12, 14, 16 and 17 in accordance with the number of closings of the switch 59. As the user of the control pad 42*a* provides successive actuations or depressions of the button 58, signals are introduced to a shift register 90 through a line 92 to indicate which one of the vehicles 12, 14, 16 and 17 would be selected if there were no further depressions of the button. Each one of the depressions of the button 58 causes the indication to be shifted to the right in the shift register 90. Such an indication is provided on an individual one of a plurality of light emitting diodes (LED), generally indicated at 93. The shifting of the indication in the shift register 90 may be synchronized with a clock signal on a line 95. Thus, the illuminated one of the light emitting diodes 93 at each instant indicates at that instant the individual one of the vehicles 12, 14, 16 and 17 that the control pad 42*a* has selected at such instant.

The central station 64 is shown in additional detail in FIG. 3. It includes a microcontroller, generally indicated at 94, having a read only memory (ROM) 96 and a random access memory (RAM) 98. As with the memories in the microcontroller 76 in the control pad 42*a*, the read only memory 96 stores permanent information and the random access memory 98 stores volatile (or impermanent) information. For example, the read only memory 96 sequentially selects successive ones of the control pads 42*a*, 42*b*, 42*c* and 42*d* to be interrogated on a cyclic basis. The read only memory 96 also stores a plurality of addresses each individual to a different one of the vehicles 12, 14, 16 and 17.

Since the read only memory 96 knows which one of the control pads 42*a*, 42*b*, 42*c* and 42*d* is being interrogated at each instant, it knows the individual one of the control pads responding at that instant to such interrogation. The read only memory 96 can provide this information to the microcontroller 94 when the microcontroller provides for the transmittal of information to the vehicles 12, 14, 16 and 17. Alternatively, the microcontroller 76 in the control pad 42*a* can provide an address indicating the control pad 42*a* when the microcontroller sends the binary signals relating to the status of the switches 46, 48, 50 and 52 and the switches 57, 59, 62*a*, 62*b*, 63*a* and 63*b* to the central station 64.

As an example of the information stored in the random access memory 98 in FIG. 3, the memory stores information relating to each pairing between an individual one of the control pads 42*a*, 42*b*, 42*c* and 42*d* and a selective one of the vehicles 12, 14, 16 and 17 in FIG. 1 and between each individual one of such control pads and a selective one of the stationary accessories 34 and 38. The random access memory 98 also stores the status of the operation of the switches 46, 48, 50 and 52 for each control pad and the operation of the switches 57, 59, 62*a*, 62*b*, 63*a* and 63*b* for each control pad.

When the central station 64 receives from the control pad 42*a* the signals indicating the closure (or the lack of closure) of the switches 46, 48, 50 and 52 and the switches 57, 59, 62*a*, 62*b*, 63*a* and 63*b*, the central station retrieves from the read only memory 96 the address of the individual one of the vehicles indicated by the closures of the switch 59 in the control pad. The central station may also retrieve the address of the control pad 42*a* from the read only memory 96.

The central station 64 then formulates in binary form a composite address identifying the control pad 42*a* and the selected one of the vehicles 12, 14, 16 and 17 and stores this composite address in the random access memory 98. The central station 64 then provides a packet or sequence of signals in binary form including the composite address and including the status of the opening and closing of each of the switches in the control pad 42*a*. This packet or sequence indicates in binary form the status of the closure each of the switches 46, 48, 50 and 52 and the switches 57, 59, 62*a*, 62*b*, 63*a* and 63*b*.

Each packet of information including the composite addresses and the switch closure information for the control pad 42*a* is introduced through a line 102 (FIG. 3) to a radio frequency transmitter 104 in the central station 64. The radio frequency transmitter 104 is enabled by a signal passing through a line 106 from the microcontroller 94.

When the radio frequency transmitter 104 receives the enabling signal on the line 106 and the address and data signals on the line 102, the antenna 68 (also shown in FIG. 1) transmits signals to all of the vehicles 12, 14, 16 and 17. However, only the individual one of the vehicles 12, 14, 16 and 17 with the address indicated in the packet of signals from the central station 64 will respond to such packet of signals.

The microcontroller 94 stores in the random access memory 98 the individual ones of the vehicles such as the vehicles 12, 14, 16 and 17 being energized at each instant by the individual ones of the control pads 42*a*, 42*b*, 42*c* and 42*d*. Because of this, the central station 64 is able to prevent the interrogated one of the control pads 42*a*, 42*b*, 42*c* and 42*d* from selecting one of the energized vehicles. Thus, for example, if the vehicle 14 is being energized by one of the control pads 42*a*, 42*b*, 42*c* and 42*d* at a particular instant, a first depression of the button 58 in the control pad being interrogated at that instant will cause the vehicle 12 to be initially selected and a second depression of the button by such control pad will cause the vehicle 14 to be skipped and the vehicle 16 to be selected.

Furthermore, in the example above where the control pad 42*a* has previously selected the vehicle 14, the microcontroller 94 in the central station 64 will cause the vehicle 14 to be released when the control pad 42*a* selects any of the vehicles 12, 350, 16 or 17. When the vehicle 14 becomes released, it becomes available immediately thereafter to be selected by any one of the control pads 42*a*, 42*b*, 42*c* and 42*d*. The release of the vehicle 14 by the control pad 42*a* and the coupling between the control pad 42*a* and a selected one of the vehicles 12, 14, 16, 17 and 350 are recorded in the random access memory 98 in the microcontroller 94.

The vehicles 12, 14, 16 and 17 are battery powered. As a result, the energy in the batteries in the vehicles 12, 14, 16 and 17 tends to become depleted as the batteries provide the energy for operating the vehicles. The batteries in the vehicles 12 and 14 are respectively indicated at 108 and 110 in FIG. 3. The batteries 108 and 110 are chargeable by the central station 64 because the central station may receive AC power from a wall socket via a transformer 65 and cable 65*a* (FIG. 1). The batteries are charged only for a particular period of time. This particular period of time is preset in the read only memory 96. When each battery is being charged for the particular period of time, a light 109 in a circuit with the battery becomes illuminated. The charging current to each of the batteries 108 and 110 may be limited by a resistor 111. The light 109 becomes extinguished when the battery has been charged. Charging capability is provided to system 10 by any of a number of possible configurations including locations in the junction box station 35 or as separate stationary plants or other types of accessories such as those depicted by 34 and 38 (FIG. 1) any of which may be placed conveniently throughout the system 10 as desired by the users.

Each central station 64 may have the capabilities of servicing only a limited number of control pads. For example, each central station 64 may have the capabilities of servicing only the four (4) control pads 42*a*, 42*b*, 42*c* and 42*d*. It may sometimes happen that the users of the system elect to service more than four (4) control pads. Under such circumstances, the microcontroller 94 in the central station 64 and a microcontroller, generally indicated at 94*a*, in a second central station corresponding to the central station 64 may be connected by cables 114*a* and 114*b* to an adaptor, generally indicated at 115.

One end of the cable 114*b* is constructed so as to be connected to a ground 117 in the adaptor 115. This ground operates upon the central station to which it is connected so that such central station is a slave to, or subservient to, the other central station. For example, the ground 117 in the adaptor 115 may be connected to the microcontroller 94*a* so that the central station including the microcontroller 94*a* is a slave to the central station 64. When this occurs, the microcontroller 94 in the central station 64 serves as the master for processing the information relating to the four (4) control pads and the four (4) vehicles in its system and the four (4) control pads and the four (4) vehicles in the other system.

The expanded system including the microcontrollers 94 and 94*a* may be adapted so that the address and data signals generated in the microcontroller 94*a* may be transmitted by the antenna 68 in the central station 64 when the central station 64 serves as the master station. The operation of the central station 64*a* may be clocked by the signals extending through a line 118 from the central station 64 to the adaptor 115 and through a corresponding line from the other central station to the adaptor.

The microcontroller 122 includes a read only memory (ROM) 124 and a random access memory (RAM) 126. As with the memories in the control pad 42*a* and the central station 64, the read only memory 124 may store permanent information and the random access memory 126 may store volatile (or impermanent) information. For example, the read only memory 124 may store information indicating the sequence of the successive bits of information in each packet for controlling the operation of the motors 28, 30, 32 and 33 in the vehicle 12. The random access memory 126 stores information indicating whether there is a binary 1 or a binary 0 at each successive bit in the packet.

The particular embodiment reflected by vehicle 12 includes a plurality of switches 128, 130 and 132. These switches are generally pre-set at the factory to indicate a particular Arabian number such as the number "5". However, the number can be modified by the user to indicate a different number if two central stations are connected together as discussed above and if both stations have vehicles identified by the numeral "5". The number can be modified by the user by changing the pattern of closure of the switches 128, 130 and 132. The pattern of closure of the switches 128, 130 and 132 controls the selection of an individual one of the vehicles such as the vehicles 12, 14, 16 and 17. Additional switches similar to the switches 128, 130 and 132 and configured to work in cooperation with such switches may be added to the vehicles to accommodate addressing of larger numbers of vehicles so that each may have its own unique address.

The pattern of closure of the switches 128, 130 and 132 in one of the vehicles can be changed when there is only a single central station. For example, the pattern of closure of the switches 128, 130 and 132 can be changed when there is only a single central station with a vehicle identified by the numeral "5" and when another user brings to the central station, from such other user's system, another vehicle identified by the numeral "5".

The vehicle 12 also includes a light such as a light emitting diode 134. This diode is illuminated when the vehicle 12 is selected by one of the control pads 42*a*, 42*b*, 42*c* and 42*d*. In this way, the other users can see that the vehicle 12 has been selected by one of the control pads 42*a*, 42*b*, 42*c* and 42*d* in case one of the users (other than the one who selected the vehicle 12) wishes to select such vehicle. It will be appreciated that each of the vehicles 12, 14, 16 and 17 may be generally different from the others so each vehicle may be able to perform functions different from the other vehicles. This is another way for each user to identify the individual one of the vehicles that the user has selected.

As previously described, the user of one of the control pads such as the control pad 42*a* selects the vehicle 12 by successively depressing the button 58 a particular number of times within a particular time period. This causes the central station 64 to produce an address identifying the vehicle 12. When this occurs, the central station 64 stores information in its random access memory 98 that the control pad 42*a* has selected the vehicle 12. Because of this, the user of the control pad 42*a* does not thereafter have to depress the button 58 during the time that the control pad 42*a* is directing commands through the station 64 to the vehicle 12. As long as the buttons on the control pad 42*a* are depressed within a particular period of time to command the vehicle 12 to perform individual functions, the microprocessor 94 in the central station 64 will direct the address of the vehicle 12 to be retrieved from the read only memory 96 and to be included in the packet of the signals transmitted by the central station to the vehicle 12.

The read only memory 96 in the microprocessor 94 at the central station 64 stores information indicating a particular period of time in which the vehicle 12 has to be addressed by the control pad 42*a* in order for the selective coupling between the control pad and the vehicle to be maintained. The random access memory 98 in the microcontroller 94 stores the period of time from the last time that the control pad 42*a* has issued a command through the central station 64 to the vehicle 12. When the period of time in the random access memory 98 equals the period of time in the read only memory 96, the microcontroller 94 will no longer direct commands from the control pad 42*a* to the vehicle 12 unless the user of the control pad 42*a* again depresses the button 58 the correct number of times within the particular period of time to select the vehicle 12.

The vehicle 12 also stores in the read only memory 124 indications of the particular period of time in which the vehicle 12 has to be addressed by the control pad 42*a* in order for the selective coupling between the vehicle and the control pad to be maintained. This period of time is the same as the period of time specified in the previous paragraph. The random access memory 126 in the microcontroller 122 stores the period of time from the last time that the control pad 42*a* has issued a command to the vehicle 12.

Once the particular button 58 of particular pad has been actuated to select and energize a vehicle, that vehicle remains operative and associated with such particular pad for a predetermined period of time as dictated by random access memory 126. When the period of time stored in the random access memory 126 of the microcontroller 122 in the vehicle equals the period of time in the read only memory 124, the microcontroller 122 issues a command to extinguish the light emitting diode 134. This indicates to the different users of the system, including the user previously controlling the operation of the vehicle 12 that the vehicle is available to be selected by any one of the users, including the user previously directing the operation of that vehicle.

When one of the vehicles such as the vehicle 12 is being moved in the forward direction, the random access memory 126 records the period of time during which such forward movement of the vehicle 12 is continuously occurring. This count is continuously compared in the microcontroller 122 with a fixed period of time recorded in the read only memory 124. When the period of time accumulated in the random access memory 126 becomes equal to the fixed period of time recorded in the read only memory 124, the microcontroller 122 provides a signal for increasing the speed of the movement of the vehicle 12 in the forward direction. Similar arrangements are provided for each of the vehicles 14, 16 and 17. This increased speed may illustratively be twice that of the original speed.

The system and method described above have certain important advantages. They provide for the operation of a plurality of vehicles by a plurality of users, either on a competitive or a cooperative basis. Furthermore, the vehicles can be operated on a flexible basis in that a vehicle can be initially selected for operation by one user and can then be selected for operation by another user after the one user has failed to operate the vehicle for a particular period of time. The vehicles being operated at each instant are also visible by the illumination of the lights 134. The apparatus and method of this invention are also advantageous in that the vehicles are operated by the central station 64 on a wireless basis without any physical or cable connection between the central station and the vehicles.

Furthermore, the central station 64 communicates with the vehicles in the plurality through a single carrier frequency. The system and method of this invention are also advantageous in that the vehicles can selectively perform a number of different functions including forwardly and rearwardly movement, as well as turns to the left and to the right, and manipulation of accessories such as containers, bins or platforms carried on the respective vehicles. Different movements can also be provided simultaneously on a coordinated basis. Vehicles may also be employed in a cooperative manner to work with stationary plants and accessories 34 and 38 for the movement and storage of materials such as blocks 24 and marbles 26.

Figure 4:
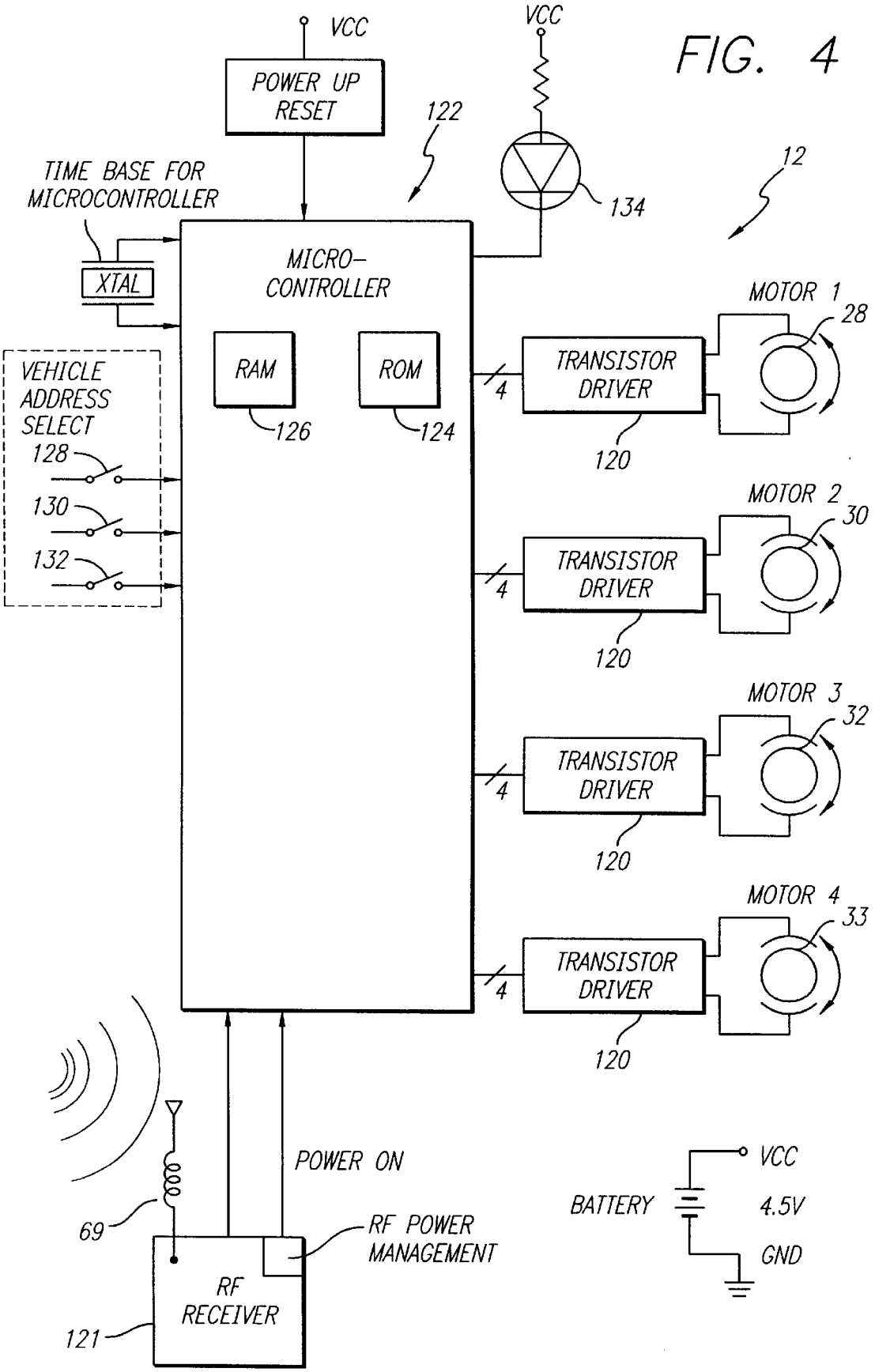
FIG. 4 is a schematic diagram, primarily in block form, of the different features in a vehicle included in the system shown in FIG. 1.
Figure 5:
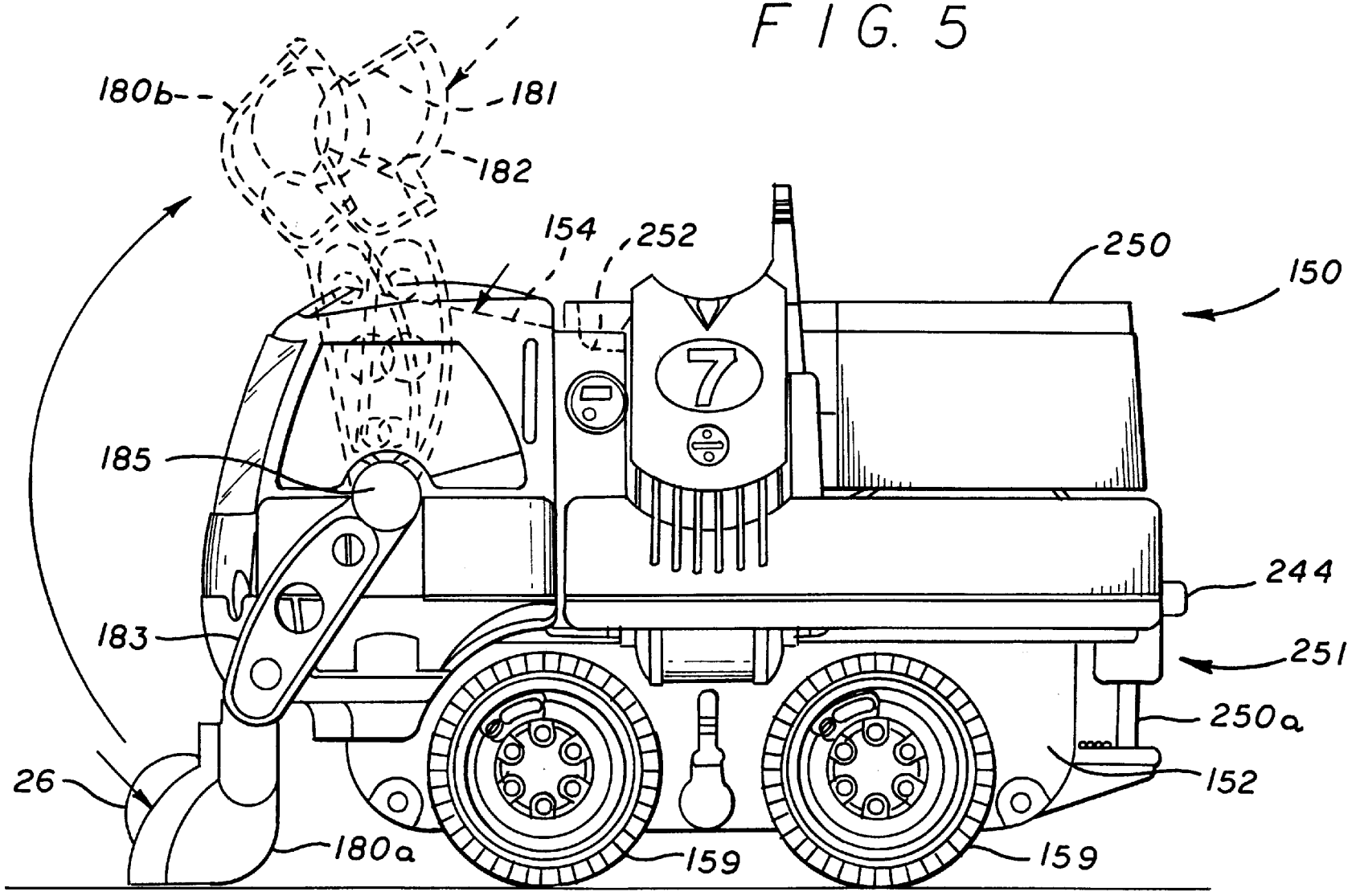
FIG. 5A is a side view of an embodiment of a toy fork lift vehicle having a gripper assembly.
FIG. 5B is a front view of the toy fork lift vehicle depicted in FIG. 5A illustrating the details of the gripper assembly.
Figure 5A:
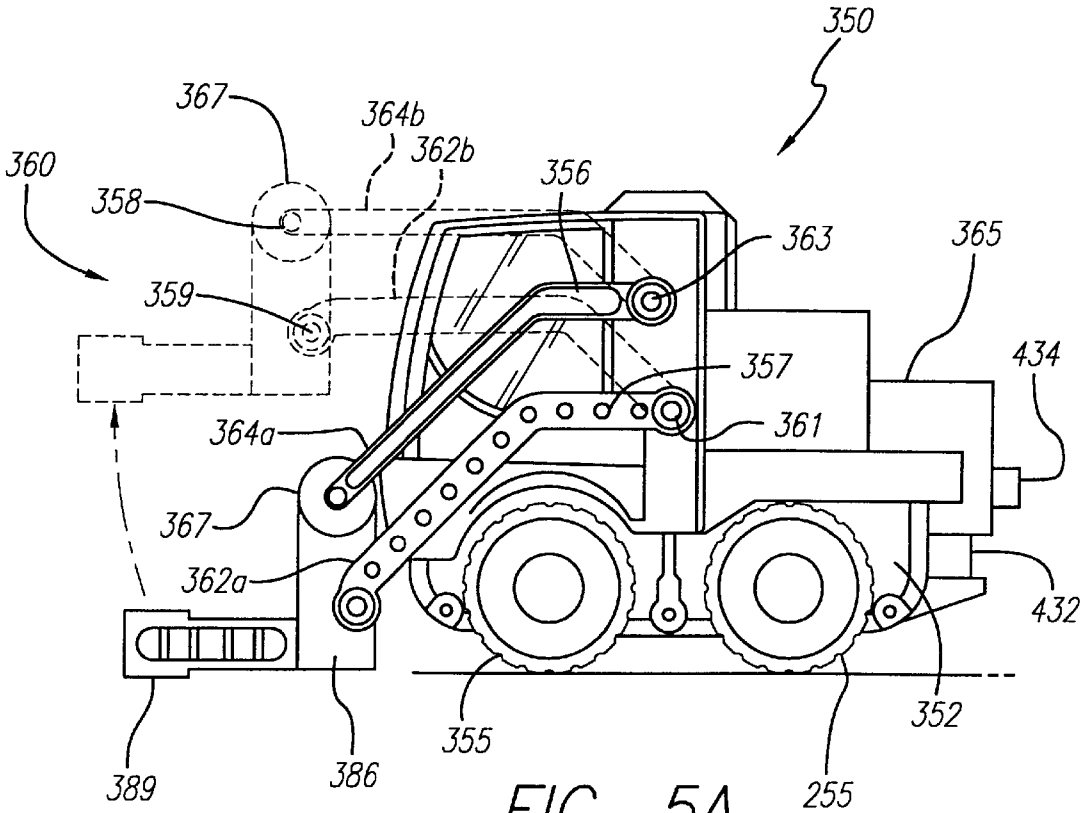
Figure 5B:
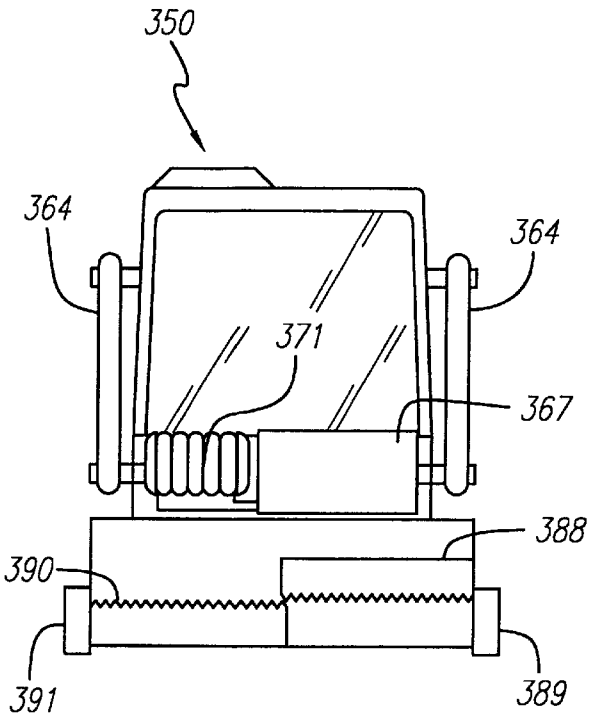

Referring now to FIGS. 5A and 5B, a fork lift 350 incorporating several novel aspects of the present invention is shown. The fork lift 350 has four wheels 355 (only the wheels 355 on the left side are shown), a front and rear left pair of wheels driven by the motor 28 (FIG. 4), and a front and rear right pair of wheels driven by the motor 30 (FIG. 4). The front wheels are mounted on a front axle and the rear wheels are mounted a rear axle. Typically, the two axles are of equal length, although the axles could be of different lengths. The width of the wheels and axle, measured from the outside of the wheel on the left side of the fork lift 350 to the outside of the wheel on the right side of the fork lift 350 is commonly called the track of the vehicle.

The axles are mounted to a chassis 352 at selected, spaced apart locations on a bottom side of the chassis 352. The distance between the cross-sectional center of the front axle and the cross-sectional center of the rear axle is typically known in the art as the wheel base of the vehicle.

The fork lift 350 has a rotatable lifter arm shaft 361 and a leveling arm shaft 363 rotatably mounted in the chassis 352 and extending through the chassis 352 such that the ends of the lifter arm shaft 361 and the leveling arm shaft 363 extend beyond the sides of the chassis 352. A proximal end of an upper lifter arm 356 is mounted on the end of the leveling arm shaft 363 extending through the left side of the chassis 352. A distal end of the upper lifter arm 356 is mounted to a rotatable shaft 358 rotatably mounted in a left side of an upper portion of a gripper assembly 360. Similarly a proximal end of an upper lifter arm 356 is mounted on the end of the leveling arm shaft 363 extending through the right side of the chassis 352. A distal end of the upper lifter arm 356 is mounted to a rotatable shaft 358 rotatably mounted in a right side of the upper portion of the gripper assembly 360.

A proximal end of a lower lifter arm 357 is mounted on the end of the lifter arm shaft 361 extending through the left side of the chassis 352. A distal end of the lower lifter arm 357 is mounted to a rotatable shaft 359 rotatably mounted in the left side of a lower portion of the gripper assembly 360. Similarly a proximal end of a lower lifter arm 357 is mounted on the end of the lifter arm shaft 361 extending through the right side of the chassis 352. A distal end of the lower lifter arm 357 is mounted to a rotatable shaft 359 rotatably mounted in the right side of the lower portion of the gripper assembly 360. The structure formed by this arrangement of upper and lower lifter arms 356, 357 and shafts 358, 359, 361 and 363 form a parallel four bar assembly. When lifter arm shaft 361 is rotationally driven by a motor, as will be described more fully below, the rotation of lifter arm shaft 361 in one direction operates to lift the gripper assembly 360 in an upwardly direction. Rotation of the lifter arm shaft 361 in the opposite direct operates to lower the gripper assembly 360. The four bar assembly translates the rotation of lifter arm shaft 361 such that the gripper assembly 360 is lifted and lowered in a parallel manner, e.g., bins or other items gripped by the gripping assembly 360 are prevented from tipping during lifting or lowering. Use of this assembly is thus useful in preventing the contents of a bin from spilling while being lifted or lowered by the fork lift 350.

The fork lift 350 also has a counterweight 365 mounted to the chassis 352. The counterweight 365 assists in balancing the weight of a bin or object gripped by the gripper assembly 360 when the gripper assembly is controlled to lift the bin or object to prevent overbalancing or tipping of the fork lift 350. A hitch pin 432 is mounted on the rear of the chassis 352 of the fork lift 350. The hitch pin 432 may be used as an attachment point for a cable attached to an object or structure such that the fork lift 350 may be controlled to pull the object or structure. Alternatively, a trailer may be attached to the hitch pin 432.

Figure 6:
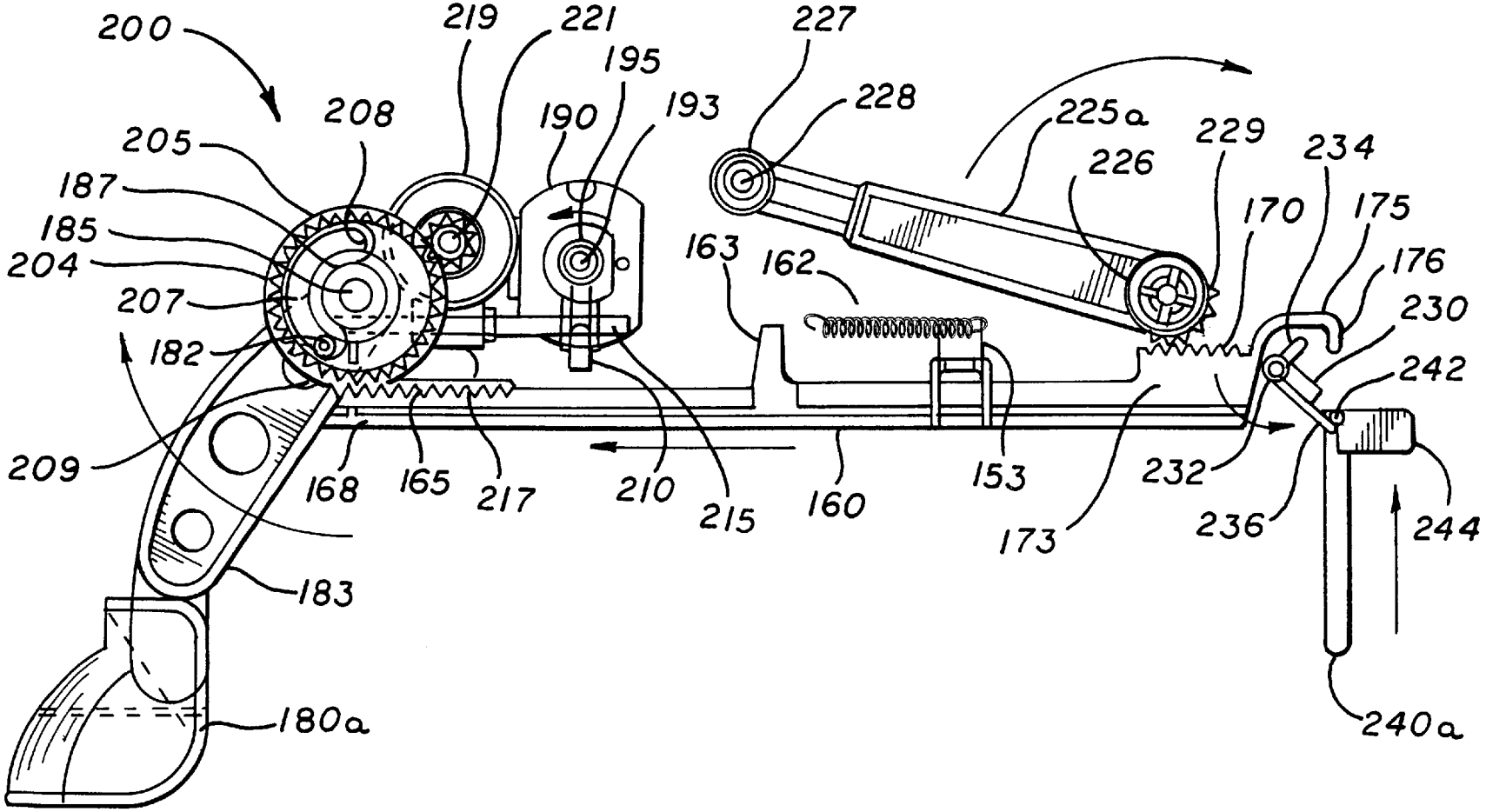
FIG. 6 is a front view of the motor and gear assembly of the gripper assembly of the toy fork lift vehicle of FIG. 5A.

The gripper assembly 360 comprises a body 368 on which is mounted a motor 367, a gear assembly 371 and a pair of gripper arms 389 and 391 mounted to a first gear rack 388 and a second gear rack 390 respectively (FIG. 5B). Referring now to FIG. 6, the motor 367 has a transistor drive 369, which is similar in design and function to the motor 32 and its respective transistor driver 120 described in FIG. 4. A worm gear 370 is mounted on a distal end of the shaft of motor 367. The worm gear 370 is meshed to cluster gear 372 mounted about shaft 374 which is secured to the body 368 of the gripper assembly 360. A spur gear 367 is also mounted on the shaft 374 such that spur gear 367 rotates in a coordinated fashion with cluster gear 372. A spur gear and clutch 380 is mounted on a distal end of a rotatable shaft 382, the proximal end of which is rotatably mounted to the body 368 of the gripper assembly 360. The spur gear 376 is meshed to the spur gear and clutch 380 mounted on axle 382. A pinion gear 384 is also mounted on shaft 382 such pinion gear 384 rotates in coordination with the rotation of the spur gear and clutch 380. The first gear rack 388 and the second gear rack 390 are slidably mounted to the body 368 of the gripper assembly 360 and are in opposing engagement with the pinion gear 384. Grips 389 and 391 are mounted on the outermost lateral ends of gears racks 388 and 390 respectively.

Figure 7:
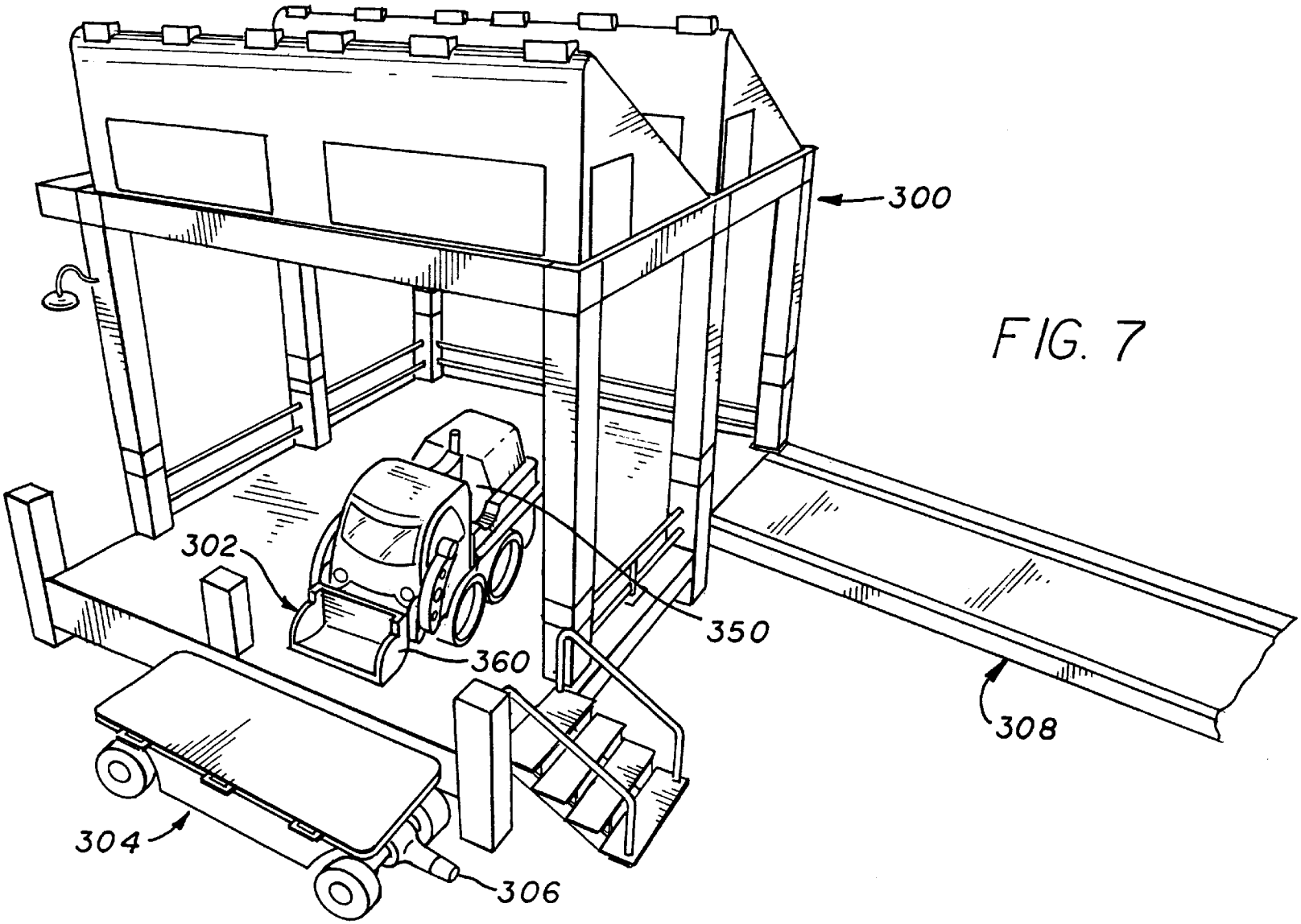
FIG. 7 is an isometric, elevational view showing an embodiment of the motor and gear mechanism for raising and lowering the gripper assembly and for opening and closing the hitch pin of the vehicle shown in FIG. 5A.

FIG. 7 depicts one embodiment of an arrangement of motor and gears that is capable of rotating the lifter arm shaft 361 to lift and lower the gripper assembly 360 and to actuate the hitch pin 432. A motor 405 having a transistor driver 407 is mounted on the chassis 352 of the fork lift 350 (not shown). The motor has a rotating shaft 406 that is driven by the motor in response to control signals from the transistor driver 407. A worm gear 408 is mounted on a distal end of the motor shaft 406. A spur gear 410 is mounted at a first end of a shaft 412 and a worm gear 414 is mounted on a second, opposite end of the shaft 412. The shaft 412 is rotatably mounted to the chassis 352, and positioned such that the teeth of spur gear 410 engage the teeth of the worm gear 408.

A generally "Z" shaped linkage plate 427 is slidably mounted on the chassis 352. At a first end of the linkage plate 427, there is an upturned portion 413. The upturned portion 413 has a generally flat face 416 and an upper end 418. The upper end 418 has a pair of generally hooked shaped tabs 418*a* and 418*b* extending towards a second end of the linkage plate 427. The hook shaped tabs 418*a* and 418*b* are formed to rotatably receive and retain one end of a rotating shaft 419. The other end of shaft 419 is rotatably mounted to the chassis 352.

A clutch gear 415 is mounted on the shaft 419, and meshes with the teeth of the worm gear 414. A spur gear 417 is also mounted on the shaft 419 such that spur gear 417 rotates in coordination with clutch gear 415 when shaft 419 rotates. A follower roller 424 is mounted on the shaft 419 between the hook shaped tabs 418*a* and 418*b* of the upper end 418 of the upturned portion 413 of the linkage plate 427. The follower roller 424 is mounted on the shaft 419 such that the roller 424 may rotate independent of the rotation of the shaft 419.

A spur gear 420 is mounted on the lifting arm shaft 361 and in operative engagement with the gear 417 mounted on shaft 419. A cam 422 is also mounted on the lifter arm shaft 361.

When the motor 405 is controlled to lift the gripper assembly 360, the motor shaft 406, and thus worm gear 408, may rotate in a clockwise direction. This clockwise rotation of worm gear 408 produces a counterclockwise rotation of spur gear 410, which is transmitted by shaft 412 to rotate worm gear 414 in a counterclockwise direction, which causes the clutch gear 415 to rotate in a clockwise direction. Since clutch gear 415 is fixedly mounted to shaft 419, gear 417, also fixedly mounted on shaft 419, also rotates in a clockwise direction. Clockwise rotating gear 417, in operative engagement with gear 420, causes gear 420 to rotate in a counterclockwise direction. This counterclockwise rotation of gear 420 causes the lifter arm shaft to also rotate in a counterclockwise direction, which in turn causes the right and left lower lift arms 357 to move upwards, lifting the gripper assembly 360. As will be apparent to one skilled in the art, controlling the motor 405 to rotate shaft 406 in the opposite, or in this case, counterclockwise direction, causes the lifter arm shaft 361 to rotate in a clockwise direction to lower the right and left lift arms 357.

It will be understood that the specific ratios of the teeth of the gears described previously may be altered as necessary to change the relative rotational speeds of the various shafts. For example, the ratios of the various gears may be altered to accommodate motors 405 having different speeds, or to provide greater or lesser mechanical advantage.

At a second end of the linkage plate 427 there is a tab 426 that engages a drive arm 430 of a lever 428 mounted on a shaft 429 that is rotatably mounted to the chassis 352. The follower arm 431 of the lever 428 engages a pin 433 formed on an upper end of the hitch pin 432. Although not shown, the hitch pin 432 is slidably mounted through an opening at the rear end of the chassis such that the hinge pin 432 may move upwardly and downwardly in response to upwards and downwards movement of the end of the follower arm 433 of the lever 428.

The cam 422 mounted on the lifter arm shaft 361 is slidablely engaged with the roller 424 that is mounted on shaft 419, which in turn is rotatably mounted to the hook shaped tabs 418*a* and 418*b* of the upturned portion 413 of the linkage plate 427. In the embodiment illustrated in FIG. 7, the roller 424, and thus the linkage plate 427, is biased in a rearward direction by a spring 425 disposed between the flat face 416 of the upturned portion 413 of the linkage plate 427 and the chassis 352. When the lifter arms 357 are in the lowered position, the cam 422 engages the roller 424 and pushes the roller 424, and thus the linkage plate 427 in a forwardly direction against the rearward bias due to the spring 425. When the linkage plate 427 is in such a forward position, the tab 426 is also in a forward position, allowing the follower arm 433 of the lever 428 and hinge pin 432 to drop down, closing the hitch.

As described above, when motor 405 is controlled to rotate the lifter arm shaft 361 to lift the gripper assembly 360, the lifter arm shaft 361 rotates in the counterclockwise direction. Such rotation also causes cam 422 to rotate upwardly in coordination with the rotation. When the cam 422 has rotated upwardly a sufficient amount, the roller 424 may become disengaged from the cam 422, allowing the linkage plate 427 to move in a rearwards direction in response to the rearward bias caused by the spring 425. The rearward movement of the linkage plate 427 also causes the tab 426 to move rearwards and engage the drive arm 430 of the lever 428. As the linkage plate 427 and tab 426 move progressively rearwards, tab 426 pushes on drive arm 430, causing the lever 428 to rotate about shaft 429 and move the end of the follower arm 431 in an upwards direction. As the end of the follower arm 431 moves upwards, it engages pin 433 and lifts the hitch pin 432 upwards, opening the hitch. Similarly, when the lifter arm shaft rotates in a clockwise direction to lower the lift arms 357, the cam 422 is rotated downwards and into engagement with the roller 424, pushing roller 424 and the linkage plate 427 forwards against the bias caused by the spring 425. The forward movement of the linkage plate 427 causes the tab 426 to move forwards, allowing the lever 428 to rotate in a counterclockwise direction about the shaft 429, lowering the end of follower arm 431 and the hitch pin 432, closing the hitch.

In operation, the motorized gripping mechanism 360 of FIG. 6 is actuated by inputs originating in pads 42 after receipt by radio frequency transmission from central station 64, demodulation by vehicle receiver 121 and after processing by vehicle microcontroller 122. The mechanism 360 is operated by a single motor 367 driving the gear train described above for sliding gear racks 388 and 390 together with a clamping force sufficient to enable frictional gripping to provide lifting and translation of transportable elements such as bins or other objects. The magnitude of available clamping force depends upon the selection of a clutch 380 appropriate for the available torque of motor 367, the strength of the materials from which gripper assembly 360 is fabricated and the strength of the materials from which the transportable elements are fabricated. By design, the clutch 380 decouples the motor 367 torque from the gripping assembly once a predetermined force has been attained during the gripping of transportable elements.

Figure 8:
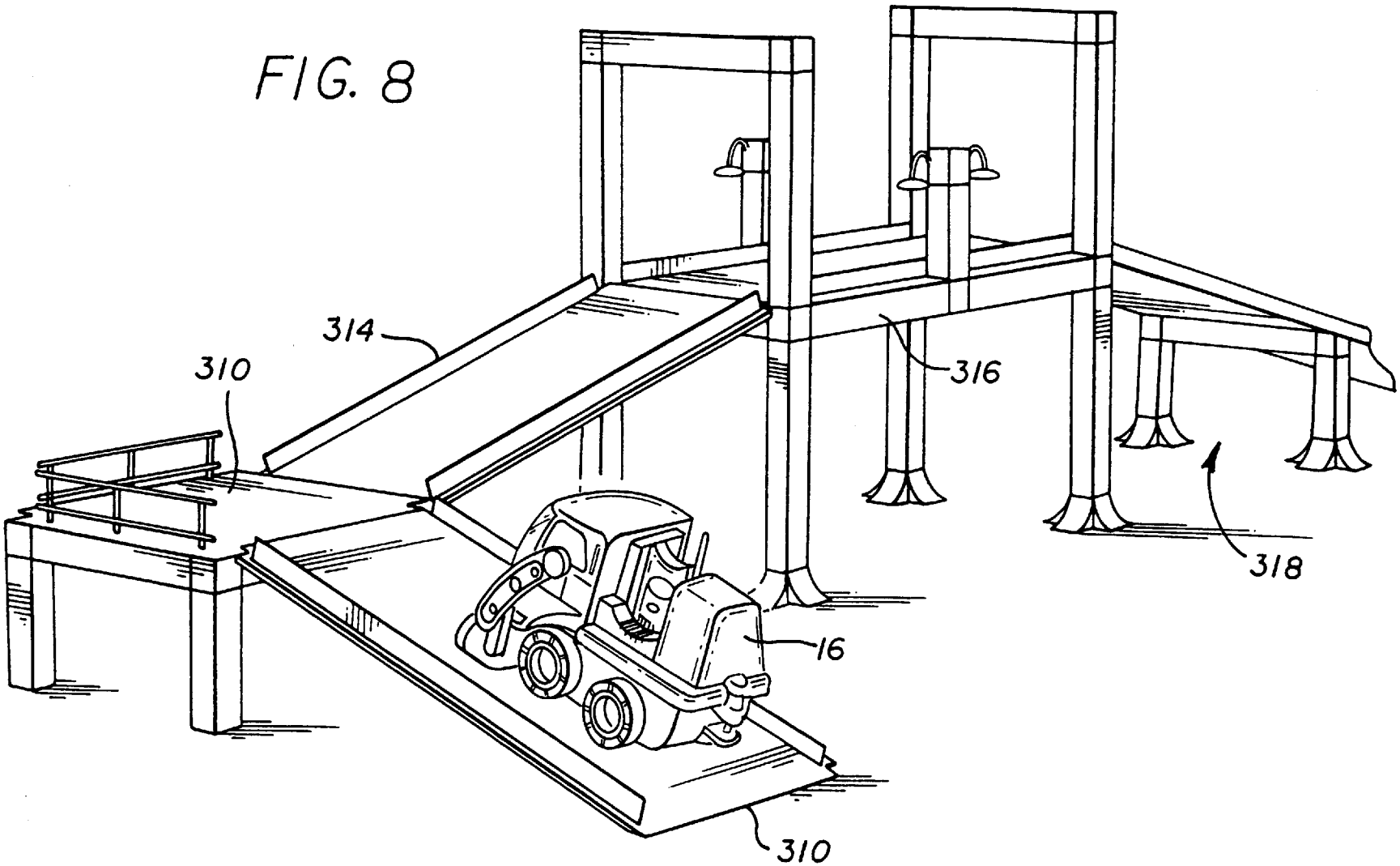
FIG. 8 is an elevational view of a loading dock accessory illustrating an environment in which the toy vehicle shown in FIG. 5A operates.
Figure 9:
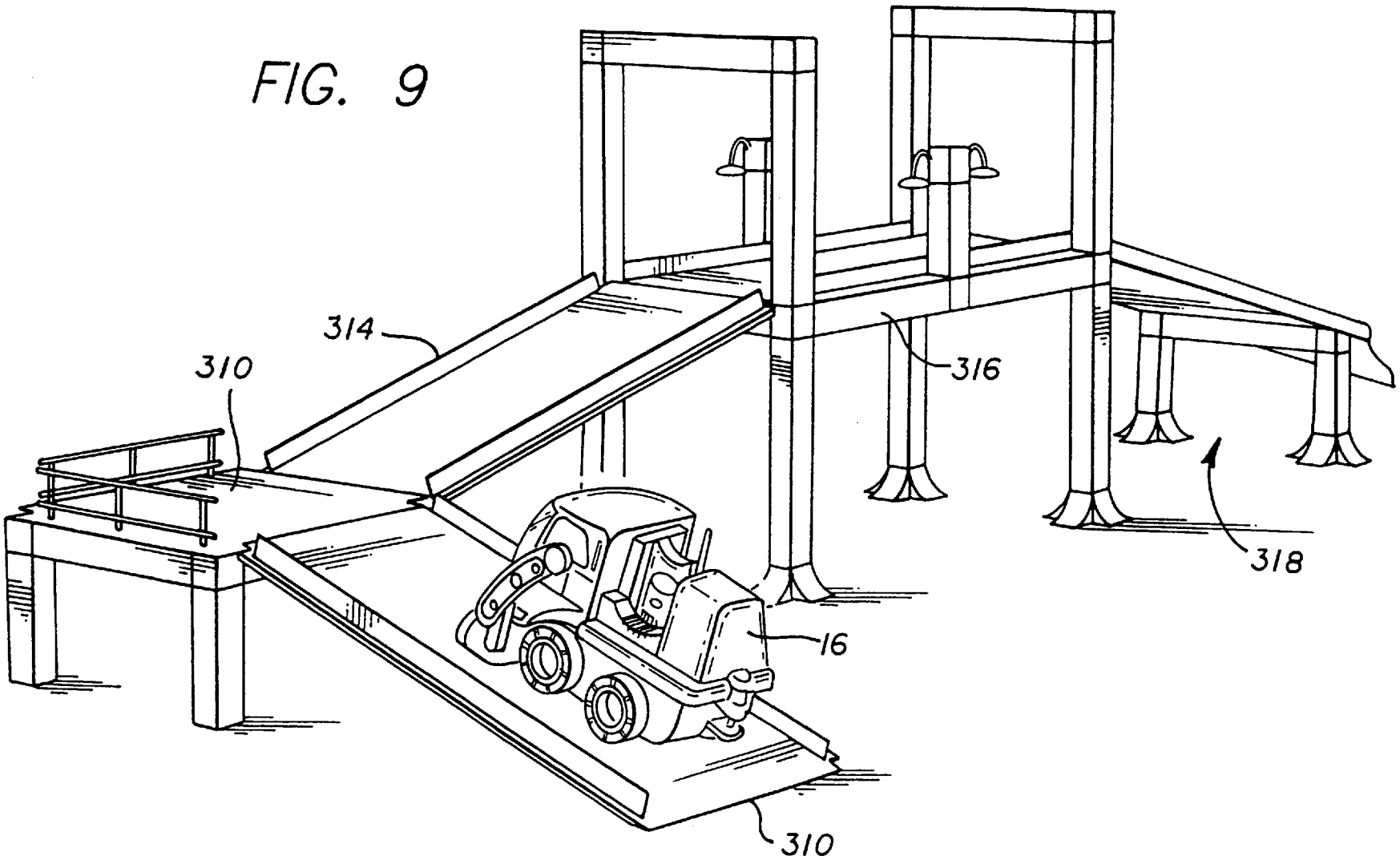
FIG. 9 is a side view of another embodiment of an accessory illustrating the play environment showing a toy bulldozer ascending a series of ramps before crossing a bridge.

Referring now to FIGS. 8 and 9, one novel aspect of the construction of the vehicles 12, 14, 16 and 17 will now be described. FIG. 8 shows one embodiment of the fork lift 350 lifting and carrying a bin 302. The fork lift 350 is shown positioned on the raised deck of a miniature model of a loading dock, generally indicated at 300. Also shown in FIG. 8 is a trailer 304 that may be connected to the vehicles 12, 14, 16, 17 and 350 by connecting a tongue 306 of the trailer 304 to the hitch 19 of a selected one of the vehicles 12, 14, 16, 17 and 350. As is apparent from FIG. 8, the fork lift 350 is capable of grasping the bin 302 with its gripper assembly and upon receiving the appropriate signal from the central station 64 (FIG. 1), can be operated to lift the bin to an elevated position. The operator may then control the fork lift 350 to move forward on the deck of the loading dock 300 until the bin 302 is suspended over the trailer 304. The fork lift can then be controlled to lower the bin 302 onto the trailer 304, and release the gripper assembly 360.

As is illustrated by FIGS. 8 and 9, various model environments can be constructed to provide for intriguing and enjoyable play by persons of youthful minds. Such model environments, however, may constrain the design and function of the vehicles 12, 14, 16, 17 and 350 so that the vehicles may be easily operated within the environment. For example, the raised deck of the loading dock 300 in FIG. 8 is accessed by the fork lift 350 by ascending an inclined ramp 308. In operation, the vehicles 12, 14, 16, 17 and 350 should be capable of climbing the ramp 308 to reach the raised deck of the loading dock 300 without suffering a loss of vehicle stability caused by the inclined attitude achieved by the vehicle as it ascends the ramp 308.

Additionally, the various structural accessories used with the system 10 may also be relatively small to maximize the use of available space. Such small accessories, such as the loading dock 300, may require that the vehicles 12, 14, 16, 17 and 350 be capable of precise movements within the tight confines of such a structure. For example, after the fork lift 350 climbs the ramp 308, it must turn sharply to the left to gain access to the trailer 304. FIG. 9 depicts a further example of the operation of a vehicle 16 to climb a ramp 310, turn to the right on an intermediate deck 318, climb a second ramp 314, traverse a bridge 316, and then descend another ramp or series of ramps 318. Precise maneuverability of the fork lift 350 and the vehicle 16 avoids unnecessary jockeying of the vehicle backwards and forwards to accomplish the sharp turns required by the dimensions of the loading dock 300 (FIG. 8) and the intermediate deck 314 (FIG. 9).

In a preferred embodiment, the vehicles 12, 14, 16, 17 and 350 accomplish the movements required to traverse the structures described above by employing skid steering. Skid steering of the vehicles 12, 14, 16, 17 and 350 is accomplished by controlling, for example, motor 28 of the fork lift 350 to cause the wheels on the left side of the fork lift 350 to rotate to move the fork lift 350 in a forwardly direction. At the same instant, motor 30 of the fork lift 350 is not energized, thus the wheels 355 on the right side of the fork lift 350 do not rotate. Since only the wheels 355 on the left side of the fork lift 350 are controlled to move the vehicle forward, the fork lift 350 pivots to the right. Alternatively, motor 30 of the fork lift 350 may be controlled to rotate the wheels 355 on the right side of the fork lift 350 in the opposite direction to the wheels 355 driven by motor 28 on the left side of the fork lift 350. In this manner, the fork lift 350 may be controlled to pivot rapidly to the right around its axis. Similarly, to turn to the left, motor 30 may be controlled to move the fork lift 350 in a forwardly direction, while motor 28 is either not energized, resulting in the wheels 355 on the left side of the fork lift 350 remaining stationary, or motor 28 may be controlled to drive the wheels on the left side of the fork lift 350 in the direction opposite to the wheels on the right side of the fork lift 350. While the concept of employing skid steering to steer a vehicle is well known in the art, the present invention controls the ratio of wheelbase and track dimensions of the vehicles 12, 14, 16, 17 and 350 in combination with careful placement of counterweights to provide for optimal maneuverability and stability.

Providing sufficient maneuverability while maintaining vehicle stability on an incline is particularly important for enjoyable operation of the fork lift 350. As a bin 302 is raised by the gripper assembly 360 of the fork lift 350, the additional weight of the bin 302 and any contents of the bin, such as marbles 26 or blocks 24 (FIG. 1) may adversely affect the stability of the fork lift 350 when it is controlled by a user to move forwards or backwards, or to turn to the right or left. Accordingly, the details of the embodiment of the present invention illustrating the improved maneuverability and stability of the vehicles 12, 14, 16, 17 and 350 is described with reference to the fork lift 350. It will be understood, however, that the principles are equally applicable to each of the vehicles 12, 14, 16 and 17.

It has been determined during testing that maneuverability and stability of the fork lift 350, and thus the vehicles 12, 14, 16 and 17, is optimized when the ratio of the track to the wheelbase of the fork lift 350 is approximately equal to 1.5. For example, a fork lift 350 having a track equal to 85 millimeters and a wheelbase equal to 55 millimeters has been found to have excellent maneuverability in the tight confines of representative model structures such as the loading dock 300 in FIG. 8, while also providing for stable operation of the fork lift 350 while ascending or descending inclined ramps as illustrated in FIGS. 8 and 9.

While several forms of the invention have been illustrated and described, it will also be apparent that various modifications can be made without departing from the spirit and scope of the invention. Accordingly, it is not intended that the invention be limited, except by the appended claims.

What is claimed is:

1. In combination in a toy vehicle for providing a controlled coupling of the toy vehicle to a movable member, a chassis, a first axle mounted on the chassis and having first and second opposite ends, a second axle mounted on the chassis and having first and second opposite ends, the distance between the first and second opposite ends defining a wheelbase for the vehicle, first wheels respectively disposed on the first and second axles in a longitudinal direction at the first end of the axles, second wheels respectively disposed on the first and second axles in the longitudinal direction at the second ends of the axles, the distance between the first and the second wheels on each of the axles defining a track, a first motor having first and second modes of operation and operatively coupled to the first wheels for rotating the first wheels in a first direction in the first mode of operation and for rotating the first wheels in a second direction in the second mode of operation, a second motor having first and second modes of operation and operatively coupled to the second wheels for rotating the second wheels in the first direction in the first mode of operation and for rotating the second wheels in the second direction in the second mode of operation, a controller operatively coupled to the first and second motors for producing a forward movement of the vehicle with the first and second motors rotating in the first direction, for producing a rearward movement of the wheels with the first and second motors rotating in the rearward direction, for producing a turning of the vehicle with only one of the motors rotating and for producing a skid steering of the vehicle with one of the motors rotating in the first direction and the other motor rotating in the second direction, a hitch assembly mounted on the vehicle for attaching the toy vehicle to the movable member, coupling members responsive to the movement of the fork arms for providing a controlled attachment, and detachment, of the hitch assembly to, and from, the movable member, and the track and the wheel base in the vehicle having a particular ratio to facilitate stable operation of the vehicle in the forward and rearward movements of the vehicle in the turning of the vehicle and in the skid steering of the vehicle.

2. In a combination as set forth in claim 1, the ratio of the track to the wheel base in the vehicle being approximately 1.5.

3. In a combination as set forth in claim 1 for use with transportable elements and a bin for receiving the transportable elements, forklift arms mounted on the chassis at one end of the vehicle and movable in a vertical direction to transfer the transportable elements to the bin, and a counterweight mounted on the chassis at the opposite end of the vehicle from the forklift arms to balance the weight of the forklift arms and the bin when the forklift arms lift the bin.

4. In a combination as set forth in claim 1 for use with transportable elements for receiving the transportable elements, forklift arms mounted on the chassis and movable in a direction to lift the transportable elements, and a third motor operatively coupled to the forklift arms for moving the forklift arms in the direction to lift the transportable elements, a pair of gripper arms disposed in co-operative relationship with the forklift arms and movable laterally relative to each other to grip the transportable elements, and a fourth motor operatively coupled to the gripper arms to move the gripper arms laterally to obtain a gripping of the transportable elements by the gripper arms.

5. In a combination as set forth in claim 1, the vehicle having a particular address, a plurality of pads each operative to provide first binary indications representing the particular address and second binary indications providing commands for operating the first and second motors in the vehicle, and a central station for sending the first and second binary indications from the pads to the vehicle.

6. In a combination as set forth in claim 4, the vehicle having a particular address, a plurality of manually held pads each manually operative to provide first binary indications representing the particular address and second binary indications providing commands for operating the first, second, third and fourth motors, and a central station for sending the first and second binary indications from the pads to the vehicle.

7. In combination in a toy vehicle for transporting transportable elements, a chassis, wheels mounted on the chassis for selectively moving the vehicle forwardly and rearwardly, turning the vehicle to the right or left and skid steering the vehicle to the right or left, the wheels constituting a pair of forward wheels and a pair of rearward wheels, motors mounted on the chassis for selectively rotating the wheels to move the vehicle forwardly and rearwardly, turn the vehicle to the right and the left and skid steer the vehicle to the right and the left, the distance between the forward and rearward wheels defining a wheelbase and the distance between the forward wheels defining a track, the ratio of the track having a particular ratio relative to the wheelbase to provide for a stable operation of the vehicle even during the skid turning of the vehicle, pairs of forklift arms mounted on the vehicle to define a substantially parallel four bar assembly and movable to lift and lower the transportable elements, a counterweight mounted on the vehicle to balance the forklift arms in lifting the transportable elements, and an additional motor operatively coupled to the pairs of the forklift arms to move the forklift arms in a vertical direction, a pair of gripper arms disposed on the forklift arms and movable in a lateral direction relative to each other to grip or release the transportable elements, and a further motor operatively coupled to the gripper arms to move the gripper arms in the lateral direction relative to each other, a hitch assembly mounted on the vehicle for attaching the toy vehicle to the movable member, and coupling members responsive to the vertical movement of the fork arms in the substantially parallel four bar assembly for providing a controlled attachment and detachment of the hitch assembly to, and from, the movable member.

8. In combination as set forth in claim 7, the vehicle having an individual address, the vehicle constituting one of a plurality of vehicles each having an individual address, a plurality of pads each manually operable to provide first binary indications representing any one of the individual addresses of the vehicles not addressed by any of the other pads and second binary indications providing commands for operating the addressed vehicles, and a central station for sending the first and second binary indications from each of the pads to the vehicles.

9. In combination in a toy vehicle for transporting transportable elements and for coupling the vehicle to a movable member for movement of the movable member with the vehicle, a chassis, a pair of axles mounted on the chassis in a longitudinally displaced relationship to each other, wheels mounted on the opposite ends of each of the axles in the pair, motor means mounted on the chassis for providing selective rotations of the wheels to selectively move the vehicle forwardly and rearwardly, turn the vehicle to the right and the left and skid steer the vehicle to the right and to the left, fork lift arms mounted on the chassis for pivotable movements upwardly and downwardly, a gripper assembly mounted on the fork lift arms and including a pair of gripper arms movable in a lateral direction relative to each other to grip and release the transportable elements, a first motor operatively coupled to the fork lift arms for selectively moving the fork lift arms upwardly and downwardly, a second motor operatively coupled to the gripper assembly for selectively moving the gripper arms in the opposite lateral directions, and a hitch assembly mounted on the chassis and responsive to the upward and downward movements of the fork lift arms to selectively hitch and unhitch the hitch assembly to the movable member.

10. In a combination as set forth in claim 9 wherein the fork lift arms are disposed in a spaced relationship to define a substantially parallel four bar assembly and are movable upwardly and downwardly while maintaining the substantially parallel four bar relationship, and a counterweight disposed on the vehicle to balance the vehicle even when the fork lift arms are moving upwardly in the vertical direction with the gripper arms gripping a transportable element.

11. In a combination as set forth in claim 9, the gripper arms being operatively coupled to the fork lift arms and the gripper arms being movable laterally in opposite directions in accordance with the operation of the second motor to grip the transportable elements upon a movement of the gripper arms toward each other and to release the transportable elements upon a movement of the gripper arms away from each other.

12. In a combination as set forth in claim 9, the hitch assembly being responsive to an upward movement of the fork lift arms to unhitch the hitch assembly from the movable member and being responsive to a downward movement of the movable member to hitch the assembly to the movable member.

13. In a combination as set forth in claim 10, the distance between the wheels on the same axles defining a track and the distance between the axles defining a wheel base and the ratio of the track to the wheel base having a particular value to maintain stability in the vehicle even when the vehicle is skid turning.

14. In a combination as set forth in claim 7, a counterweight disposed on the vehicle to balance the vehicle even when the fork lift arms are moving upwardly with the gripper arms gripping the transportable element.

15. In a combination as set forth in claim 13, the gripper arms being operatively coupled to the fork lift arms and including a pair of gripper arms movable laterally in opposite directions in accordance with the operation of the second motor to grip the transportable elements upon a movement of the gripper arms toward each other and to release the transportable elements upon a movement of the gripper arms away from each other, the hitch assembly being responsive to an upward movement of the fork lifts to unhitch the hitch assembly from the movable member and being responsive to a downward movement of the movable member to hitch the assembly to the movable member, and a counterweight disposed on the vehicle to balance the vehicle even when the fork arms are moving upwardly with the gripper arms gripping the transportable element.

16. In a combination as set forth in claim 15, the particular value for the ratio between the value of the track and the value of the wheelbase being approximately 1.5.

17. In a combination as set forth in claim 16, the fork lift arms comprising two (2) pairs of fork lift arms, each pair of the fork lift arms being pivotable on shafts in a common plane, the shafts for each pair of the fork lift arms being displaced from the shafts for the other pair of the fork lift arms and the shafts for the pairs of the fork lift arms being disposed to provide and maintain the fork lift arms in the substantially parallel four bar assembly during the upward and downward movements of the fork lift arms.

18. In a combination as set forth in claim 9, the vehicle having a particular address, a plurality of manually operable hand held pads each manually operable to provide first binary indications representing the particular address and second binary indications providing commands for operating the motor means, the first motor and the second motor, and a central station for sending the first and second binary indications from each of the pads to the vehicle.

19. In combination in a toy vehicle for transporting transportable elements and for providing a controlled coupling of the toy vehicle to a movable member, a chassis, a pair of axles mounted on the chassis in a longitudinally displaced relationship to each other, wheels mounted on the opposite sides of each of the axles in the pair, motor means mounted on the chassis and operatively coupled to the wheels for providing selective rotations of the wheels to selectively move the vehicle forwardly and rearwardly, turn the vehicle to the right and the left and skid steer the vehicle to the right and the left, fork lift arms mounted on the chassis for pivotable movements upwardly and downwardly, the fork lift arms being disposed in a spaced relationship to define a substantially parallel four bar assembly and being movable upwardly and downwardly while maintaining the substantially parallel four bar relationship, a first motor operatively coupled to the fork lift arms for selectively moving the fork lift arms upwardly and downwardly, a gripper assembly mounted on the fork lift arms and including a pair of gripper arms for movement in a lateral direction to grip and release the transportable elements, a second motor operatively coupled to the gripper assembly for selectively moving the gripper arms in opposite lateral directions relative to each other to grip and release the transportable elements, and a hitch assembly mounted on the chassis and responsive to the upward and downward movements of the fork lift arms to selectively hitch and unhitch the hitch assembly to the movable member.

20. In a combination as set forth in claim 19, the fork lift arms being disposed at one end of the vehicle, and a counterweight disposed on the vehicle at the opposite end of the vehicle to balance the effect on the vehicle of moving the fork lift arms upwardly with the transportable elements gripped by the gripper arms.

21. In a combination as set forth in claim 20, the distance between the wheels on the same axle being defining a track and the distance between the axles being defining a wheelbase and the ratio of the track to the wheelbase being approximately 1.5.

22. In a combination as set forth in claim 19, the vehicle having a particular address, a plurality of manually hands held pads each manually operative to provide first binary indications representing the particular address and second binary indications providing commands for operating the motor means, the first motor and the second motor, and a central station for sending the first and second binary indications from the pads to the vehicle.

23. In combination:

a remotely-controlled toy lift vehicle including an elongated chassis;

a first work arm mounted rotationally from a first location on said chassis for rotation from a first to second position;

a driver arm mounted movably from a second location on said chassis;

a drive motor mounted on said chassis; and a drive mechanism coupled between said motor and said first arm and said driver arm and operative, upon activation of said motor for rotation in one direction, to rotate said first arm through a predetermined arc from said first position to a selected position without moving said drive arm, and further operative, upon continued rotation of said motor in said one direction, to move said driver arm.

24. In combination:

a remotely-controlled toy vehicle including a chassis having a longitudinal track;

an elongated linkage member received slidably in said track and formed with forward and rearward extremities configured with a forward follower and a rearward catch;

a first work arm mounted rotatably on one end from a forward portion of said chassis and projecting therefrom to be rotated between first and second positions;

a drive motor on said chassis;

a gear train coupled with said motor and including a gear meshed with said linkage member and operative upon activation of said motor in one direction, to initially rotate said first arm through a predetermined arc while leaving said linkage member at rest and to, upon continued activation of said motor in said one direction, drive said linkage member in an activation direction in said track; and a driver arm movably mounted rearwardly on said chassis and including a drive arm in the path of said catch to be moved by said linkage member as it moves forwardly and rearwardly in said track.

25. In combination as recited in claim 24:

said first work arm including a shaft having a cam for driving a follower positioned in the path of said cam and carried from said linkage member for movement of said linkage member in said track as said first work arm is rotated about said shaft.

26. In combination as set forth in claim 24:

said motor being operative upon activation in said one direction to rotate said first arm and drive said linkage member in said track through a predetermined path to an unhitching position, said linkage member including a catch;

a hitch pin having a drive tab movably mounted on said chassis and having a hitching position and an unhitching position; and said driver movably mounted from said chassis and including a follower disposed in the path of said catch to, as said linkage member is moved to said unhitching position, be engaged by said catch to drive said driver from a hitching to an unhitching position, said driver further including a driver engageable with said hitch pin as said drive is rotated to said unhitching position to move said hitch pin from said hitching to said unhitching position.

27. In combination as set forth in claim 24 that includes:

a spring device coupled between said chassis and said linkage member to bias said linkage member to a rearwardly position.

28. In a combination as set forth in claim 24 including:

support wheels carrying said chassis; and a drive motor device mounted on said chassis to drive said wheels.

29. In combination for moving a holding member and for coupling to a movable member for movement with the movable member, a toy vehicle having a chassis, motive means mounted on the chassis for moving the toy vehicle in different directions, a fork lift assembly including fork lift arms mounted on the chassis for pivotable movement upwardly and downwardly relative to the chassis, means operatively coupled to the fork lift arms for moving the fork lift arms upwardly and downwardly relative to the chassis, a gripper assembly including a pair of gripper arms mounted on the fork lift arms for lateral movement relative to the fork lift arms and, including a pair of gripper members, the gripper assembly being supported by the fork lift arms for movement upwardly and downwardly with the fork lift arms, means operatively coupled to the gripper arms for moving the gripper arms laterally in a first direction to provide for a retention of the holding member by the gripper members and movable laterally in a second direction opposite to the first direction to provide for a release of the holding member by the gripper members, and a hitch assembly mounted on the chassis and responsive to the upward and downward movements of the fork lift arms to selectively hitch and unhitch the hitch assembly to the movable member.

30. In a combination as set forth in claim 29, means included in the hitch assembly for biasing the hitch assembly to the hitched relationship with the movable member.

31. In a combination as set forth in claim 29, the gripper assembly being operative to move the gripper arms in first opposite lateral directions relative to each other to positions providing for a gripping of the holding member by the gripper members and being operative to move the gripper arms in second opposite lateral directions relative to each other to positions providing for a release of the holding member by the gripper members.

32. In a combination as set forth in claim 29, the fork lift assembly including first and second shafts disposed on the chassis in vertically spaced relationship to each other and including a first pair of fork lift arms mounted in the first shaft for rotation upwardly and downwardly and including a second pair of fork lift arms mounted on the second shaft for rotation upwardly and downwardly.

33. In a combination as set forth in claim 32, each of the fork lift arms in the first and second pairs having first and second opposite ends, the first and second shafts being operatively coupled respectively to the first ends of the first and second pairs of the fork lift arms, and third and fourth shafts respectively coupled to the second ends of the first and second pairs of the fork lift arms, and the gripper assembly being operatively coupled respectively to the second ends of the first and second pairs of the fork lifts arms.

34. In a combination as set forth in claim 29, a counterweight disposed on the vehicle to balance the vehicle even when the fork lift arms are moving upwardly with the gripper members gripping the holding member.

35. In a combination as set forth in claim 30, the gripper assembly being operative to move the gripper arms in first opposite lateral directions relative to each other to positions providing for a gripping of the holding member by the gripper members and being operative to move the gripper arms in second opposite lateral directions relative to each other to a position providing for a release of the holding member by the gripper members;

the fork lift assembly including first and second shafts disposed on the chassis in vertically spaced relationship to each other and including a first pair of fork lift arms mounted on the first shaft for rotation upwardly and downwardly and including a second pair of fork lift arms mounted on the second shaft for rotation upwardly and downwardly;

each of the fork lift arms in the first and second pairs having first and second opposite ends, the first and second shafts being operatively coupled respectively to the first ends of the first and second pairs of the fork lift arms, third and fourth shafts respectively coupled to the second ends of the first and second pairs of shafts, the gripper assembly being operatively coupled respectively to the second ends of the first and second pairs of shafts, and a counterweight disposed on the vehicle to balance the vehicle even when the fork lift arms are moving upwardly with the gripper members gripping the holding member.

36. In combination for moving a holding member and for providing a controlled coupling of the toy vehicle to a movable member, a toy vehicle having a chassis and having a pair of axles mounted on the chassis in a longitudinally displaced relationship to each other and having wheels mounted on the opposite sides of each of the axles in the pair, motive means mounted on the chassis and operatively coupled to the wheels for providing selective rotations of the wheels to move the vehicle forwardly and rearwardly and to turn the vehicle to the right and left, a fork lift assembly mounted on the chassis for pivotable movement upwardly and downwardly, first means operatively coupled to the fork lift assembly for moving the fork lift assembly upwardly and downwardly, a gripper assembly including a pair of gripper arms mounted on the fork lift assembly for lateral movement relative to each other and relative to the fork lift assembly and including a pair of gripper members supported by the gripper arms for gripping the holding member in first lateral dispositions of the gripper arms for movement of the holding member upwardly and downwardly with the fork lift assembly and for releasing the holding member in second lateral dispositions of the gripper arms, second means operatively coupled to the gripper assembly for moving the gripper arms laterally relative to each other and relative to the fork lift assembly to the first and second lateral dispositions of the gripper arms, and a hitch assembly mounted on the chassis and responsive to the upward and downward movements of the fork lift arms to selectively hitch and unhitch the hitch assembly to the movable member.

37. In a combination as set forth in claim 36, the gripper assembly being operative to move the gripper arms in first opposite lateral directions relative to each other to positions providing for a gripping of the holding member by the gripper members and the gripper arms being operative in second opposite lateral directions relative to each other to positions providing for a release of the holding member by the gripper members.

38. In a combination as set forth in claim 36, the gripper assembly being disposed at a first end of the vehicle, and a counterweight disposed on the vehicle at a second end opposite the first end to balance the effect produced by the movement of the gripper assembly upwardly with the holding member retained by the gripper members.

39. In a combination as set forth in claim 36, the vehicle having a particular address, a pad for producing signals representing the particular address of the vehicle, representing movements of the vehicle, representing movements of the fork lift assembly and representing movements of the gripper arms on the gripper assembly, and means responsive in the vehicle to the signals produced in the pad and representing the particular address for obtaining an operation of the motive means, the first means and the second means in accordance with the signals produced in the pad.

40. In a combination as set forth in claim 36, the fork lift assembly including shafts disposed on the chassis and including fork lift arms mounted on the shafts for rotation, the shafts and the fork lift arms being disposed relative to one another to define a parallelogram.

41. In a combination as set forth in claim 36, the gripper arms being movable in first opposite lateral directions relative to each other to positions providing for a gripping of the holding member by the gripper members and in second opposite lateral directions relative to each other to positions providing for a release of the holding member by the gripper members.

42. In a combination as set forth in claim 37, the gripper assembly being disposed at a first end of the vehicle, a counterweight disposed on the vehicle at a second end opposite the first end to balance the effect produced by the movement of the gripper assembly upwardly with the holding member retained by the gripper members, the vehicle having a particular address, a pad for producing signals representing the particular address of the vehicle, representing movements of the vehicle, representing movements of the fork lift assembly and representing movements of the gripper arms on the gripper assembly, and means responsive in the vehicle to the signals produced in the pad and representing the particular address for obtaining an operation of the motive means, the first means and the second means in accordance with the signals produced in the pad, the fork lift assembly including shafts disposed on the chassis and including fork lift arms mounted on the shafts for rotation, the shafts and the fork lift arms being disposed relative to one another to define a parallelogram, and the gripper arms being movable in first opposite lateral directions relative to each other to positions providing for a gripping of the holding member by the gripper members and in second opposite lateral directions relative to each other to positions providing for a release of the holding member by the gripper members.

43. In a combination as set forth in claim 42, the fork lift assembly including first and second shafts rotatably disposed on the chassis, including a first pair of fork lift arms having first and second ends and disposed at the first ends on the first shaft and, including a second pair of fork lift arms having first and second ends and disposed at the first ends on the second shaft, the gripper arms being disposed on the second ends of the first and second pairs of fork lift arms, the first and second shafts and the first and second pairs of the fork lift arms defining parallelogram relationships.

44. In combination for coupling a movable member constructed to be coupled by a hitch pin for movement, a vehicle having a chassis and having wheels mounted on the chassis for rotation, motive means for rotating the wheels to provide for movements of the vehicle forwardly and rearwardly and to provide for turning movements of the vehicle in opposition directions, a shaft mounted on the chassis for rotation in first and second opposite directions, a fork lift assembly operatively coupled to the shaft for movement of the fork lift assembly upwardly and downwardly in accordance with the rotation of the shaft respectively in the first and second opposite directions, and a hitch pin assembly constructed to receive a hitch pin and responsive to the rotation of the shaft in the first direction for providing for a movement of the hitch pin into coupled relationship with the movable member and responsive to the rotation of the shaft in the second direction for providing for a movement of the hitch pin into a decoupled relationship with the movable member for a movement of the vehicle and the movable member independently of each other.

45. In a combination as set forth in claim 44, means in the hitch pin assembly for biasing the hitch pin assembly to the decoupled relationship with respect to the movable member.

46. In a combination as set forth in claim 44, a cam coupled to the shaft for rotation with the shaft, means in the hitch assembly for biasing the hitch assembly to the unhitched relationship, and means responsive to the rotation of the cam in a particular direction for freeing the hitch assembly to move the hitch pin against the biasing action of the biasing means into the coupled relationship with the movable member.

47. In a combination as set forth in claim 44, a coupling member, a cam rotatable with the shaft and releasably coupled to the coupling member to provide for a release of the cam from the coupling member upon the rotation of the cam in a particular direction, biasing means, a linkage plate operatively coupled to the biasing means and the coupling member for obtaining a movement of the linkage plate by the biasing member upon the release of the cam from the coupling member, and means operatively coupled to the linkage plate for providing for a movement of the hitch pin relative to the movable member in accordance with the movement of the linkage plate by the biasing means.

48. In a combination as recited in claim 44, the fork lift assembly including shafts rotatably mounted on the chassis and a fork lift arm rotatable with the shaft and defining at least one parallelogram with the shaft.

49. In a combination as set forth in claim 48, a coupling member, a cam rotatable with the shaft and releasably coupled to the coupling member to provide for a release of the cam from the coupling member upon the rotation of the cam in a particular direction, biasing means, a linkage plate operatively coupled to the biasing means and the coupling member for obtaining a movement of the linkage plate by the biasing member upon the release of the cam from the coupling member, and means operatively coupled to the linkage plate for providing for a movement of the hitch pin relative to the movable member in accordance with the movement of the linkage plate by the biasing means.

50. In a combination as set forth in claim 47, the fork lift assembly including first and second shafts rotatably disposed on the chassis, a first pair of fork lift arms having first and second ends and disposed at the first ends of the first shaft, a second pair of fork lift arms having first and second ends and disposed at the first ends on the second shaft, the gripper arms being disposed on the second ends of the first and second pairs of the fork lift arms, and the first and second shafts and the first and second pairs of the fork lift arms defining parallelogram relationships.

51. In combination in a toy vehicle for transporting transportable elements and for coupling the vehicle to a movable member, a chassis, a pair of axles mounted on the chassis in a longitudinally displaced relationship to each other, wheels mounted on the opposite ends of each of the axles in the pair, the distance between the pair of axles defining a wheelbase and the distance between the wheels on each of the axles defining a track, motor means mounted on the chassis for providing selective rotations of the wheels to selectively move the vehicle forwardly and rearwardly, turn the vehicle to the right and the left and skid steer the vehicle to the right and to the left, a fork lift assembly mounted on the chassis and including fork lift arms for pivotable movements upwardly and downwardly, a gripper assembly mounted on the fork lift arms and including a pair of gripper arms movable in a lateral direction relative to each other to grip and release the transportable elements, a first motor operatively coupled to the fork lift assembly for selectively moving the fork lift arms upwardly and downwardly, a second motor operatively coupled to the gripper assembly for selectively moving the gripper arms in the opposite lateral directions, a counter weight mounted on the chassis at the opposite end of the vehicle from the forklift arms to balance the weight of the forklift arms in moving upwardly and downwardly, a hitch assembly mounted on the chassis and including coupling members responsive to the upward and downward movements of the fork lift arms to selectively hitch and unhitch the hitch assembly to the movable member, the vehicle having a particular address, a plurality of hand held pads each manually operative to provide first binary indications representing the particular address and second binary indications providing commands for operating the motor means, the first motor and the second motor, and a central station for sending the first and second binary indications from the pads to the vehicle.

52. In a combination as set forth in claim 51, the ratio of the track to the wheel base being approximately 1.5.

53. In combination for use with a holding member and for coupling to a movable member for movement with the movable member, a toy vehicle having a chassis and axles mounted on the chassis in longitudinally displaced relationship and wheels mounted on each of the axles in laterally displaced relationship, first motive means mounted on the chassis for moving the toy vehicle in different directions including spin turning the vehicle, a fork lift assembly including fork lift arms mounted on the chassis for pivotable movement upwardly and downwardly relative to the chassis, second motive means operatively coupled to the fork lift arms for moving the fork lift arms upwardly and downwardly relative to the chassis, a gripper assembly supported by the fork lift arms for movement upwardly and downwardly with the fork lift arms relative to the chassis, the gripper assembly including a pair of gripper arms mounted on the fork lift arms for lateral movement relative to the fork lift arms, third motive means operatively coupled to the gripper arms for moving the gripper arms laterally in a first direction to provide for a retention of the holding member by the gripper arms and movable laterally in a second direction opposite to the first direction to provide for a release of the holding member by the gripper arms, a hitch assembly mounted on the chassis and responsive to the upward and downward movements of the fork lift arms to selectively hitch and unhitch the hitch assembly to the movable member, a counterweight disposed on the vehicle to balance the weight of the fork lift arms in moving upwardly and downwardly, the distance between the wheels on each axle defining a track and the distance between the axles defining a wheel base and the ratio of the track to the wheel having a value to maintain stability in the vehicle even when the vehicle is skid turning.

54. In a combination as set forth in claim 53, the ratio of the track to the wheel base being approximately 1.5.

55. In combination for use with a holding member and for coupling to a movable member for movement with the movable member, a toy vehicle having a chassis and axles mounted on the chassis in longitudinally displaced relationship and wheels mounted on the axles in laterally displaced relationship, first motive means mounted on the chassis for moving the toy vehicle in different directions, a fork lift assembly including fork lift arms mounted on the chassis for pivotable movement upwardly and downwardly relative to the chassis, second motive means operatively coupled to the fork lift arms for moving the fork lift arms upwardly and downwardly relative to the chassis, a gripper assembly supported by the fork lift arms for movement upwardly and downwardly with the fork lift arms relative to the chassis, the gripper assembly including a pair of gripper arms mounted on the fork lift arms for lateral movement relative to the fork lift arms, third motive means operatively coupled to the gripper arms for moving the gripper arms laterally in a first direction to provide for a retention of the holding member by the gripper arms and movable laterally in a second direction opposite to the first direction to provide for a release of the holding member by the gripper arms, a hitch assembly mounted on the chassis and responsive to the upward and downward movements of the fork lift arms to selectively hitch and unhitch the hitch assembly to the movable member, a counterweight disposed on the vehicle to balance the weight of the fork lift arms when the fork lift arms are moving upwardly and downwardly, the distance between the wheels on each axle defining a track and the distance between the axles defining a wheel base and the ratio of the track to the wheel having a value to maintain stability in the vehicle even when the vehicle is skid turning, the vehicle having a particular address, and means for addressing the vehicle with the particular address and for providing commands to the vehicle for selectively operating the first, second and third motive means to move the vehicle in any direction including skid turning the vehicle, to move the lift arms upwardly and downwardly relative to the vehicle and to move the gripper arms selectively in the first and second lateral directions.

56. In a combination as set forth in claim 55, the fork lift arms including first and second pairs disposed relative to one another to define a four-bar parallelogram.

57. In a combination as set forth in claim 55, the counterweight being disposed in longitudinally displaced relationship to the fork lift arms and the gripper arms and being displaced rearwardly from the fork lift arms and the gripper arms.

58. In a combination as set forth in claim 55, including, the fork lift assembly including shafts disposed on the chassis and including fork lift arms mounted on the shafts for rotation and the fork lift arms and the shafts being disposed relative to one another to define a parallelogram, a pad for producing signals representing the particular address, representing desired movements of the vehicle, representing desired movements of the fork lift arms in the fork lift assembly and representing desired movements of the gripper arms on the gripper assembly, and means responsive in the vehicle to the signals produced in the pad and representing the particular address for obtaining the desired operation of the first motive means for the vehicle, the second motive means for the fork lift arms and the third motive means for the gripper arms.

59. In a combination as set forth in claim 58, the ratio of the track to the wheel base being approximately 1.5.

* * * * *